US005497608A

United States Patent [19]

Matsumoto et al.

[11] Patent Number: 5,497,608

[45] Date of Patent: Mar. 12, 1996

[54] SHORT FIBER AND CONTINUOUS FILAMENT CONTAINING SPUN YARN-LIKE COMPOSITE YARN

[75] Inventors: Mitsuo Matsumoto, Ibaraki; Nobuo Takahashi, Ikoma; Shinji Ohwaki, Minoo; Kazushi Fujimoto, Matsumoto; Koh-ichi Iohara, Matsuyama, all of Japan

[73] Assignee: Teijin Limited, Osaka, Japan

[21] Appl. No.: 194,471

[22] Filed: Feb. 8, 1994

Related U.S. Application Data

[63] Continuation-in-part of Ser. No. 762,888, Sep. 19, 1991, abandoned.

[30] Foreign Application Priority Data

Feb. 22, 1991 [JP] Japan ..... 3-48690
Jun. 21, 1991 [JP] Japan ..... 3-175840

[51] Int. Cl.[6] ..... D02G 3/02; D02G 3/06

[52] U.S. Cl. ..... 57/207; 57/2; 57/5; 57/210; 57/224; 57/285

[58] Field of Search ..... 57/2, 5, 6, 207, 57/210, 285, 224

[56] References Cited

U.S. PATENT DOCUMENTS

| | | | |
|---|---|---|---|
| 3,822,543 | 7/1974 | Edagawa et al. | 57/6 X |
| 3,946,548 | 3/1976 | Hino et al. | 57/2 X |
| 4,058,968 | 11/1977 | Benson | 57/6 X |
| 4,060,970 | 12/1977 | Talbot | 57/140 R |
| 4,265,082 | 5/1981 | Sasaki et al. | 57/210 X |
| 4,356,690 | 11/1982 | Minorikawa et al. | 57/243 X |
| 4,382,358 | 5/1983 | Tappe et al. | 57/243 |
| 4,491,831 | 1/1985 | Sakai et al. | 340/677 |
| 4,505,100 | 3/1985 | Yoshiyaki et al. | 57/207 |
| 4,667,463 | 5/1987 | Minorikawa et al. | 57/243 |
| 5,103,626 | 4/1992 | Morrison | 57/224 |
| 5,392,588 | 2/1995 | Morrison | 57/5 |

FOREIGN PATENT DOCUMENTS

| | | | |
|---|---|---|---|
| 3634237 | 4/1988 | Germany . | |
| 3002952 | 8/1990 | Germany | 57/224 |
| 57-5932 | 1/1982 | Japan . | |
| 59-82424 | 5/1984 | Japan . | |
| 60-2715 | 1/1985 | Japan . | |

OTHER PUBLICATIONS

Manual for the U % Evenness Tester, vol. 2, by Keisokki Kogyo Co.

Uster Training Center, "Uster–Prufgerate Aufbau".

*Primary Examiner*—William Stryjewski

*Attorney, Agent, or Firm*—Burgess, Ryan and Wayne

[57] ABSTRACT

A short fiber and continuous filament composite yarn having a high grade cotton spun yarn-like soft touch, satisfactory resilience, and uniform appearance, including a core portion formed by a plurality of cold drawn, non-crimped individual filaments substantially in the form of a bundle and a peripheral portion formed around the core portion and comprising a plurality of cold drawn-cut, non-crimped short fibers having a smaller shrinkage in boiling water, and optionally, a lower denier than those of the individual filaments, random portions of the short fibers being penetrated into the bundle of the individual filaments and intertwined with the individual filaments, and other portions of the short fibers forming a plurality of loops projecting in the form of waves having different wave heights, from the core portion toward the outside thereof to form multilayered loop structures around the core portion.

9 Claims, 10 Drawing Sheets

SHORT FIBER AND CONTINUOUS FILAMENT CONTAINING SPUN YARN-LIKE COMPOSITE YARN

CROSS REFERENCE TO RELATED APPLICATION

This application is a continuation-in-part application of application Ser. No. 07/762,888, filed on Sep. 19, 1991, now abandoned, which is incorporated herein by reference.

BACKGROUND OF THE INVENTION

1) Field of the Invention

The present invention relates to a short fiber and continuous filament composite yarn and a process and apparatus for producing the same.

More particularly, the present invention relates to a short fiber and continuous filament composite yarn having an excellent resilience, an enhanced soft touch, and a uniform spun yarn-like appearance and hand, useful for forming high grade fabrics, and a process and apparatus for producing the same with a high efficiency.

2) Description of the Related Art

It is known that, among the physical properties of fibrous materials, a high resilience and a high softness are usually mutually exclusive, but a limited number of fibrous materials provided with both high resilience and high softness are found among high grade products of a few natural fibers, for example, special silk, wool, and cotton fibers.

Much research has gone into this, but a satisfactory level of both resilience and softness has been achieved in very few natural fiber materials and synthetic fiber materials.

It is considered that the provision of a fiber product provided with both a high resilience and high softness from only one type of fiber is difficult, so most efforts have been directed to the provision of fiber composite products in which two or more types of fiber materials having a different fiber thickness are utilized.

Where two or more types of short fibers are used, the resultant short fiber composite product exhibits an unsatisfactory resilience derived from the short length or crimps, which are made by a compression buckling procedure, of the short fibers.

To solve this problem, attempts have been made to increase the thickness of the short fibers, but in the resultant product, a number of ends of the thick short fibers are extended from the product to the outside, resulting in an itchy or a scratchy feeling when in use. Also, the use of thick short fibers causes an uneven blending of the thick short fibers with the thin short fibers, and accordingly, an uneven draft of the blend of the thick and thin short fibers. Therefore, it is very difficult to provide homogeneous short fiber blended yarn.

Where two or more types of multifilament bundles in which the deniers of individual filaments are different are blended, it is difficult to evenly open the individual filaments in the blend. Also, since the thermal shrinkages of the individual filaments in each bundle are similar to each other, when the multifilaments bundles are blended, the individual filaments having similar thermal shrinkages are bundled with each other to form blocks. Namely, the thick individual filaments and the thin individual filaments in the blend are not uniformly mixed. Usually, the bundles of thick individual filaments are located at peripheral portions of the resultant blended yarn. Also, the thin individual filaments are formed into loops, and thus do not exhibit a resilient touch.

Further, the multifilament bundle-blended yarn exhibits a simple and monotonous appearance, and thus it is difficult to obtain an elegant natural fiber with a spun yarn-like appearance and touch.

Generally, in the preparation of a composite yarn from two or more types of short fibers or continuous filaments having a different thickness, it is difficult to selectively arrange the thick individual short fibers or continuous filaments in a core portion of the resultant composite yarn and the thin individual short fibers or continuous filaments in the peripheral portion of the composite.

To eliminate the above-mentioned disadvantages the following has been attempted:

(1) In a spinning procedure for short fibers, inserting a bundle of continuous filaments into a core portion of the spun yarn to provide a core-spun yarn.

(2) As disclosed in Japanese Unexamined Patent Publication Nos. 59-82424 and 60-2715, draw(draft)-cutting a group of thin individual continuous filaments, and simultaneously, intertwining the resultant short fibers with a group of thick individual continuous filaments.

(3) As disclosed in Japanese Unexamined Patent Publication No. 57-5932, drawing a bundle composed of a group of thick individual continuous filaments having a high ultimate elongation with a group of thin individual continuous filaments having a low ultimate elongation, by a drawing machine or a draw-false twisting machine, while draw-cutting and intertwining the thin continuous filaments with one another.

Nevertheless, the above-mentioned measures did not provide satisfactory composite yarns having a good appearance, satisfactory resilience, and soft touch.

In the above-mentioned attempt (1), the resultant composite yarn had the following disadvantages:

(a) Since the short fibers and the continuous filaments were simply incorporated to and twisted with each other, they were weakly intertwined or entangled with each other, and thus the handling was difficult in the case of a soft twist or moderate twist yarn.

(b) An excessive feed of the short fibers to the continuous filaments was difficult, and thus the resultant composite yarn exhibited an unsatisfactory bulkiness.

(c) The short fibers had to have a small denier. When the denier was 0.8 or less, it became difficult to evenly spin the short fibers.

(d) The procedures were complicated and the productivity low, and therefore, the production cost for the core-spun yarn was too high.

The above-mentioned attempt (2) had the following disadvantages:

(a) Since a bundle of thick continuous filaments was joined with the draw-cut short fibers under a high tension, it was difficult to evenly open the thick continuous filament bundle and firmly intertwine the draw-cut thin short fibers with the thick continuous filaments.

(b) Since the thin continuous filament bundle was draw-cut at room temperature and the thick continuous filament bundle was simply arranged in parallel to the draw-cut short fiber bundle, the ratio in thermal shrinkage of the draw-cut thin short fiber bundle to the thick continuous filament bundle could not be made significantly small, and the covering effect of the thin short fibers on the thick continuous filament bundle was unsatisfactory.

(d) Sometimes the thin continuous filaments are unevenly draw-cut and thus it is difficult to produce a composite yarn having a small yarn count.

The above-mentioned attempt (3) has the following disadvantages:

(a) The draw-cutting ratio is relatively small and thus the draw-cut short fibers sometimes have a relatively large length. Also, since the draw-cutting zone in the conventional drawing machine or draw-false twisting machine is relatively long, the resultant draw-cut short fibers sometimes have a relatively large length of 600 to 700 mm, and the deviation pitch in the fiber length becomes significantly larger than that of natural fibers, and thus the resultant composite yarn exhibits an unnatural appearance.

(b) In a conventional drawing machine in which the thin individual continuous filaments are drawn-cut under a draw-cutting force of several kg per cm of the width of the filament bundle on a draw-cutting roller device in which a pair of nip rollers nip the filament bundle at one nipping point, or one or more draw-cutting apron rollers hold the filament bundle wound around the peripheries thereof, the filament bundle slips on the roller peripheries or is unevenly nipped, and thus is very difficult to be evenly draw-cut.

(c) When the number of individual filaments in the filament bundle is relatively small, the individual filaments are difficult to be uniformly bundled, and thus to be evenly nipped by the nip rollers or evenly held on the apron rollers, due to resistance of air at the free end portions of the draw-cut fibers and an action of air streams accompanying the rotation of the draw-cutting rollers, and therefore, are unevenly draw-cut.

(d) When the filament bundle is heated on a heating roller or plate, the stress of the filament bundle created against a stretch applied thereto becomes small, the heated filament bundle is easily stretched under a small stretch force, and thus unevenly drawn-cut, and the drawn-cut end portions of the resultant short fibers are thermally shrunk and exhibit an uneven dyeing property. Also, the filament bundle is drawn-cut at a high temperature and the drawn-cut short fibers and non-cut continuous filaments are heat-set at this temperature, and thus the difference in thermal shrinkage between the short fibers and the continuous filaments is very small. Therefore the resultant composite yarn does not exhibit a satisfactory bulkiness. Further, when the filament bundle is draw-fake twisted, crimps are created in the individual short fibers and continuous filaments. Since the resultant composite filament yarn is not twisted, the crimps cause an uneven intertwining of the crimped short fibers with the crimped continuous filaments, and therefore, the resultant composite yarn exhibits an uneven bulkiness and a non-uniform appearance. Sometimes the resultant composite yarn undesirably exhibits a similar touch to that of conventional false-twisted textured yarns. Furthermore, as mentioned above, the difference in thermal shrinkage between the thin and thick filaments is reduced by the heat-setting.

Under the above-mentioned circumstances, there is a strong demand for a special composite yarn having both a satisfactory resilience and a natural spun yarn-like soft touch and appearance, from synthetic filaments.

SUMMARY OF THE INVENTION

An object of the present invention is to provide a short fiber and continuous filament composite yarn having a good touch, a satisfactory resilience, and a natural fiber spun yarn-like uniform appearance, and a process and apparatus for producing the same.

Another object of the present invention is to provide a short fiber and continuous filament composite yarn useful for forming unique, elegant clothes, and a process and apparatus for producing the same with a high efficiency.

The above-mentioned objects can be attained by the short fiber and continuous filament composite yarn, process, and apparatus of the present invention.

The short fiber and continuous filament composite yarn of the present invention comprises:

(A) a core portion comprising a plurality of evenly cold-drawn, non-crimped continuous filaments extending substantially in parallel to each other and (B) a peripheral portion located around the core portion and comprising a plurality of cold draw-cut, non-crimped short fibers provided with tapered end portions thereof and having a smaller latent shrinkage in boiling water than that of the continuous filaments, the short fibers being intertwined at random portions thereof with the continuous filaments in the core portion and forming by other portions thereof a plurality of loops projecting in the form of waves having different wave heights from each other from the core portion toward the outside thereof.

Preferably, in the above-mentioned composite yarn the short fibers have a smaller denier than that of the continuous filaments.

The process of the present invention for producing the short fiber and continuous filament composite yarn comprises the steps of:

(1) Preparing a composite filament bundle comprising (a) a plurality of individual continuous filaments and (b) a plurality of other individual continuous filaments having a lower ultimate elongation than that of the individual continuous filaments (a);

(2) subjecting the composite filament bundle to a draw-cutting procedure at a draw ratio which is the same as or more than the ultimate elongation of the individual continuous filaments (b), falls between an elongation at the primary yield point and 80% of the ultimate elongation of the individual continuous filament (a), and is not more than 2.0, while press-sliding the composite filament bundle onto a surface of a sliding guide, to cause only the individual continuous filaments (b) to be stably drawn-cut and converted to individual short fibers;

(3) withdrawing the resultant drawn-cut composite filament bundle from the draw-cutting procedure; and then (4) introducing the drawn-cut composite filament bundle into an intertwining procedure in which the drawn-cut composite filament bundle is loosened and converted to a short fiber and continuous filament composite yarn in such a manner that the individual continuous filaments (a) are gathered in an inner portion of the bundle to provide a core portion of the composite yarn, random portions of the individual short fibers penetrate the core portion and are intertwined with the individual continuous filaments (a) in the core portion, and other portions of the short fibers are allowed to form a plurality of loops projecting in the form of waves each having a different wave height from the core portion toward the outside thereof, to provide a peripheral portion of the composite yarn.

In the above-mentioned process, the drawn-cut composite filament bundle is optionally false-twisted before the intertwining step, to further drawn-cut the individual continuous filaments (b).

The apparatus of the present invention for producing the short fiber and continuous filament composite yarn comprises:

(1) a feeding roller device rotatable at a feeding periphery speed for feeding a composite filament bundle comprising (a) a plurality of individual continuous filaments and (b) a plurality of other continuous filaments having a lower ultimate elongation than that of the individual continuous filament (a);

(2) a draw-cutting roller device for draw-cutting the individual continuous filaments (b) to provide individual short fibers, which device is arranged downstream of the feeding roller device and is rotatable at a higher peripheral speed than that of the feeding roller device, whereby a path of the composite filament bundle is provided between the feeding roller device and the draw-cutting roller device;

(3) a sliding guide arranged along the path of the composite filament bundle in the draw-cutting zone and having a smooth surface thereof which causes the composite filament bundle to be press-slid thereon;

(4) an intertwining device for intertwining the short fibers with the individual continuous filaments (a) to convert the drawn-cut composite filament bundle to a short fiber and continuous filament composite yarn, which device is arranged downstream of the draw-cutting roller device; and (5) a delivery roller device for delivering the resultant composite yarn, which device is arranged downstream of the intertwining device and is rotatable at a peripheral speed lower than that of the draw-cutting roller device.

In the above-mentioned apparatus, preferably the draw-cutting roller device comprises first and second rollers spaced from each other and arranged in parallel to each other, to provide a path of the drawn-cut composite filament bundle around the first and second rollers; a false-twisting device is arranged downstream of the second roller in the path; and a guide roller is arranged between the false-twisting device and the first rollers in the path.

DESCRIPTION OF THE PREFERRED EMBODIMENTS

Figure 1:
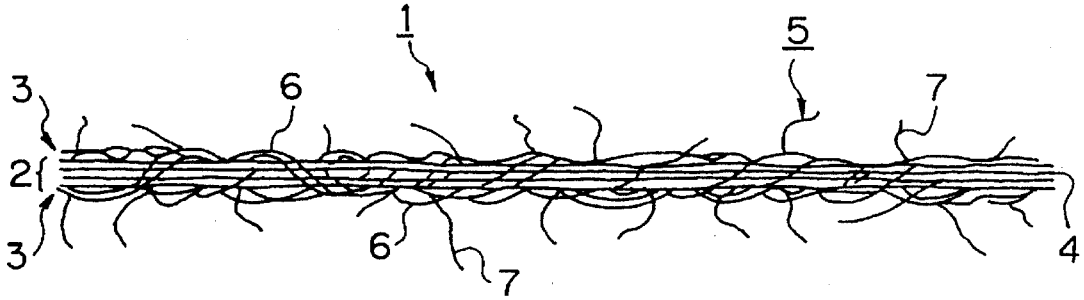
FIG. 1 is a side view of an embodiment of the short fiber and continuous filament composite yarn of the present invention.
Figure 2:
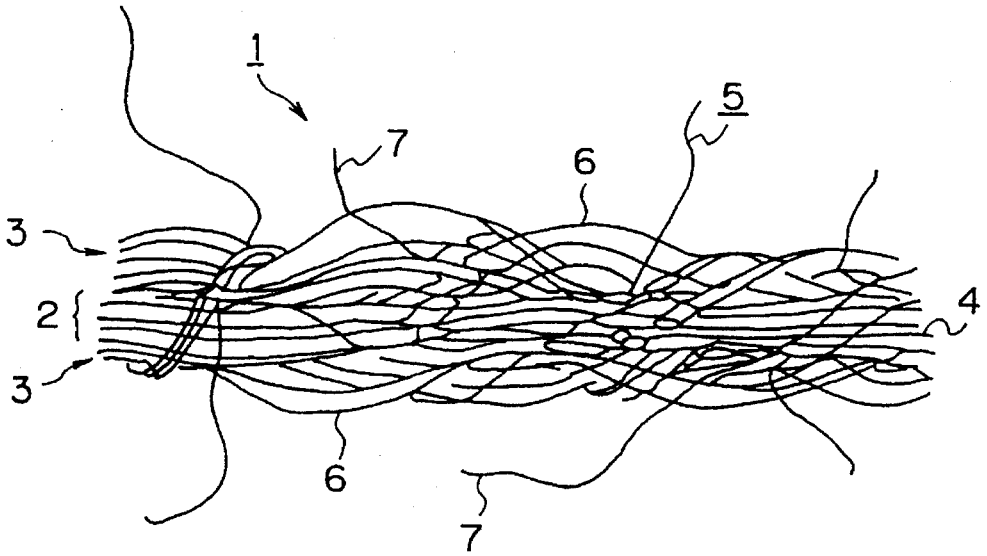
FIG. 2 is an enlarged view of a portion of the short fiber and continuous filament composite yarn of the present invention shown in FIG. 1.

The constitutions of the short fiber and continuous filament composite yarn of the present invention are illustrated in FIGS. 1 and 2.

Referring to FIGS. 1 and 2, a short fiber and continuous filament composite yarn 1 comprises a core portion 2 and a peripheral portion 3 thereof.

The core portion 2 comprises a plurality of synthetic continuous filaments 4 which have been prepared by evenly cold drawing and non-crimping a bundle of a plurality of synthetic individual continuous filaments, which extend substantially in parallel to each other.

The peripheral portion 3 is located around the core portion 2 so as to cover the core portion 2. The peripheral portion 3 comprises a plurality of synthetic short fibers 5 produced by cold draw-cutting a bundle of a plurality of synthetic individual continuous filaments. The cold drawn-cut individual short fibers 5 are provided with tapering end portions thereof and have a smaller latent shrinkage in boiling water than that of the continuous filaments.

In the composite yarn 1, the individual short fibers 5 are intertwined at random portions thereof with the individual continuous filaments 4 in the core portion 2. Other random portions of the individual short fibers 5 form a plurality of loops projecting in the form of waves having different heights from the core portion toward the outside thereof. Some end portions of the short fibers 5 in the peripheral portions 3 are projected to the outside of the core portion 2 and form tapering free ends thereof. When the end portions of short fibers are intertwined or entangled with the individual continuous filaments, these end portions may be in a tapered or pointed form.

The short fiber and continuous filament composite yarn of the present invention must have the following features.

(a) Neither the individual continuous filaments nor the short fibers are crimped, (b) The individual continuous filaments are uniformly cold drawn in the draw-cutting procedure for the individual short fibers, (c) The individual short fibers have a latent shrinkage in boiling water smaller than that of the individual continuous filaments, (d) Each individual short fiber is provided with at least one tapered (or pointed) end portion thereof, and (e) The individual short fibers form a plurality of loops projecting in the form of waves from the core portion composed of the individual continuous filaments toward the outside thereof, these waves each having a different height.

The effects of the features (a) to (e) are as follows.

Feature (a)

When the filaments or fibers are crimped as in a spun yarn or false-twisted textured yarn, the flexural stiffness and flexural recovery of the filaments or fibers are decreased, and thus the resultant yarn or fabric produced from the crimped filaments or fibers exhibits a reduced resilience. Also, the use of the crimped filaments or fibers causes the resultant yarn or fabric to exhibit an undesirably increased stretchability and bulkiness.

Accordingly, if the crimped continuous filaments and short fibers are used, the resultant short fiber and continuous filament composite yarn exhibits similar properties such as touch and appearance as those of conventional spun yarns or false twisted textured yarns.

Feature (b)

Since the cold drawn individual short fibers exhibit a high shrinkage in boiling water and cold drawn individual short fibers and continuous filaments have a high thermosetting property, after the composite yarn or fabric is dyed and finished, the stresses generated in the yarn or fabric can be easily released by applying a thermosetting procedure to the yarn or fabric, and a high resilience can be imparted to the yarn or fabric. Also, the uniform cold drawing is important to prevent a creation of a non-uniform dyeing property of the resultant composite yarn.

Feature (c)

If the shrinkage in boiling water of the short fibers is higher than that of the continuous filaments, the continuous filaments are in a loosened condition and are easily moved to the peripheral portion of the composite yarn. The continuous filaments usually have a larger thickness and a higher stiffness than those of the short fibers. Therefore, the location of the continuous filaments in the peripheral portion of the composite yarn causes the resultant composite yarn to exhibit an undesirably hard touch.

Feature (d)

Natural cotton and wool fibers have tapered end portions thereof. Accordingly, the tapered portions formed in the short fibers cause the resultant composite yarn to exhibit a natural fiber yarn-like soft touch. Also, the tapering of the short fiber ends causes the physical properties of the short fibers to vary in the longitudinal direction of the short fibers, and thus the resultant composite yarn exhibits a complicated natural fiber yarn-like touch and appearance.

Feature (e)

Since the end portions of the short fibers are tapered, the shrinkage in boiling water of the short fibers gradually changes along the longitudinal axes thereof. Usually the shrinkage in boiling water of the short fibers is at the highest level in the middle portion thereof and is gradually reduced from the middle portion to the end portions thereof.

Due to the change in the wave heights of the loops formed by the short fibers, the composite yarn of the present invention exhibits a satisfactory resilience and bulkiness.

In the composite yarn of the present invention, the individual short fibers from which the peripheral portion is formed preferably have a smaller denier (thickness) than that of the individual continuous filaments which are located substantially in the core portion.

Also, in the composite yarn of the present invention, the latent shrinkage in boiling water of the individual short fibers varies along the longitudinal axes of the fibers.

Preferably, the average latent shrinkage in boiling water of the individual short fibers is 16% or less. Also, the individual continuous filaments have an average shrinkage in boiling water of more than that of the individual short fibers, preferably of 8% to 30%.

In the composite yarn of the present invention, the individual continuous filaments are substantially bundled altogether to form a core portion, random portions of the individual short fibers are pierced into the bundle of the continuous filaments in a transverse direction to the composite yarn and intertwined or entangled with the individual continuous filaments, other random portions of the individual short fibers form a plurality of loops projected in the form of waves having different wave heights from each other, from the continuous filament bundle (the core portion) toward the outside thereof to form the peripheral portion of the composite yarn; and portions of the tapered free end portions of the short fibers are projected from the continuous filament bundle (the core portion) toward the outside thereof to form a portion of the peripheral portion of the composite yarn, whereby the latent shrinkage in boiling water of the composite yarn is caused to vary at random not only in the transverse directions but also in the longitudinal directions of the composite yarn and the core portion is covered by the peripheral portion.

The composite yarn of the present invention having the above-mentioned features (a) to (e) preferably satisfies the following relationship.

$$dA/dB \geqq 2 \quad \text{(i)}$$

wherein dA represents a denier of the individual continuous filaments and dB represents a denier of the individual short fibers.

$$dB < 2 \quad \text{(ii)}$$

$$3.3 \geqq DA/DB \geqq 0.3 \quad \text{(iii)}$$

wherein DA represents a total denier of the individual continuous filaments and DB represents a total denier of the individual short fibers in the composite yarn.

$$LB_0/LA_0 \geqq 1.01 \quad \text{(iv)}$$

wherein $LA_0$ represents a length in mm of the composite yarn measured under a load of 2 mg/d, and $LB_0$ represents a length in mm of the same composite yarn as mentioned above when stretched to an extent such that the loops formed by the individual short fibers in the peripheral position substantially disappear.

$$LB_1/LA_1 \geqq 1.03 \quad \text{(v)}$$

wherein $LA_1$ represents a length in mm of the composite yarn when shrunk in boiling water for 20 minutes, dried, and then measured under a load of 2 mg/d, and $LB_1$ represents a length in mm of the same composite yarn as mentioned above, when shrunk in boiling water for 20 minutes, dried, and then stretched to an extent such that the loops formed by the individual short fibers in the peripheral portion substantially disappear.

$$S \leqq 25 \quad \text{(vi)}$$

wherein S represents a shrinkage (%) in boiling water of the composite yarn.

$$60 > L_m > 10 \quad \text{(vii)}$$

wherein $L_m$ represents an average length in cm of the individual short fibers.

The feature represented by the relationship (i) (dA/dB ≧2) is preferable for attaining the specific soft touch of the composite yarn due to the combination of the specific peripheral portion with the specific core portion. The composite yarn of the present invention more preferably satisfies the relationship:

$$6 \geqq dA/dB \geqq 4$$

The feature represented by the relationship (ii) is also preferable for imparting a specific soft touch to the composite yarn of the present invention.

When the feature represented by the relationship (iii) is combined with the feature of the relationship (i), the resultant composite yarn can give an enhanced resilience together with a specific soft touch.

The feature represented by the relationships (iv) is derived from the fact that the short fibers form a plurality of loops projecting in the form of waves, having different wave heights, from the core portion comprising a bundle of the individual continuous filaments. The length $LA_0$ corresponds to the real length of the continuous filaments and the length $LB_0$ corresponds to the real length of the short fibers joined to the continuous filaments. Accordingly, in a certain length of the composite yarn, the real length of the short fibers is preferably 1.01 times or more the real length of the continuous filaments, to provide the loops.

Relationship (v) shows a preferable feature for obtaining a bulky yarn by heat treating the composite yarn in boiling water.

Relationship (vi) shows a preferable feature for obtaining a bulky yarn from the composite yarn with a satisfactory productivity. If S >25, the resultant bulky yarn exhibits a lowered handling property in practical use.

Relationship (vii) shows a preferable feature for obtaining a composite yarn having a natural spun yarn-like appearance.

More preferably, the composite yarn of the present invention has the following features.

(1) In the individual short fibers, the shrinkage in boiling water gradually varies along the longitudinal axes of the fibers. The middle portions of the short fibers have a larger shrinkage in boiling water than that of the end portions thereof. Also the average shrinkage in boiling water of the short fibers is 16% or less. This feature causes the plurality of loops in the peripheral portion of the composite yarn to exhibit various shrinkages different from each other, and thus the composite yarn exhibits a special soft touch and bulkiness. If the average shrinkage in boiling water is more than 16%, the difference in shrinkage in boiling water between the short fibers and the continuous filaments becomes small, and thus the resultant composite yarn has a lowered bulkiness and sometimes the individual continuous filaments are exposed to the outside of the composite yarn. The exposed continuous continuous filaments cause the resultant composite yarn to exhibit an undesirable stiff touch.

(2) (a) Random portions of the short fibers are pierced into the bundle of the continuous filaments in transverse directions of the composite yarn and intertwined or entangled with the continuous filaments.

(b) Also, in the peripheral surface portion of the composite yarn, other random portions of the short fibers are projected from the continuous filament bundle toward the outside thereof to form a multilayered structure composed of a plurality of loops in the form of waves having various wave heights or to provide a plurality of fluffs. Accordingly, the above-mentioned feature of the short fibers causes the shrinkage in boiling water of the composite yarn to vary not only in the longitudinal direction but also in the transverse direction of the composite yarn and the bundle of the individual continuous filaments in the core portion to be covered by the multilayers of the short fibers.

(3) The composite yarn has a high uniformity as a whole and satisfies the relationship (iv);

$$U \cdot N^{1/2} \leqq 104$$

wherein U represents a measured U% of the composite yarn and N represents the total number of the short fibers and the continuous filaments appearing in a cross-section of the composite yarn.

Figure 3:
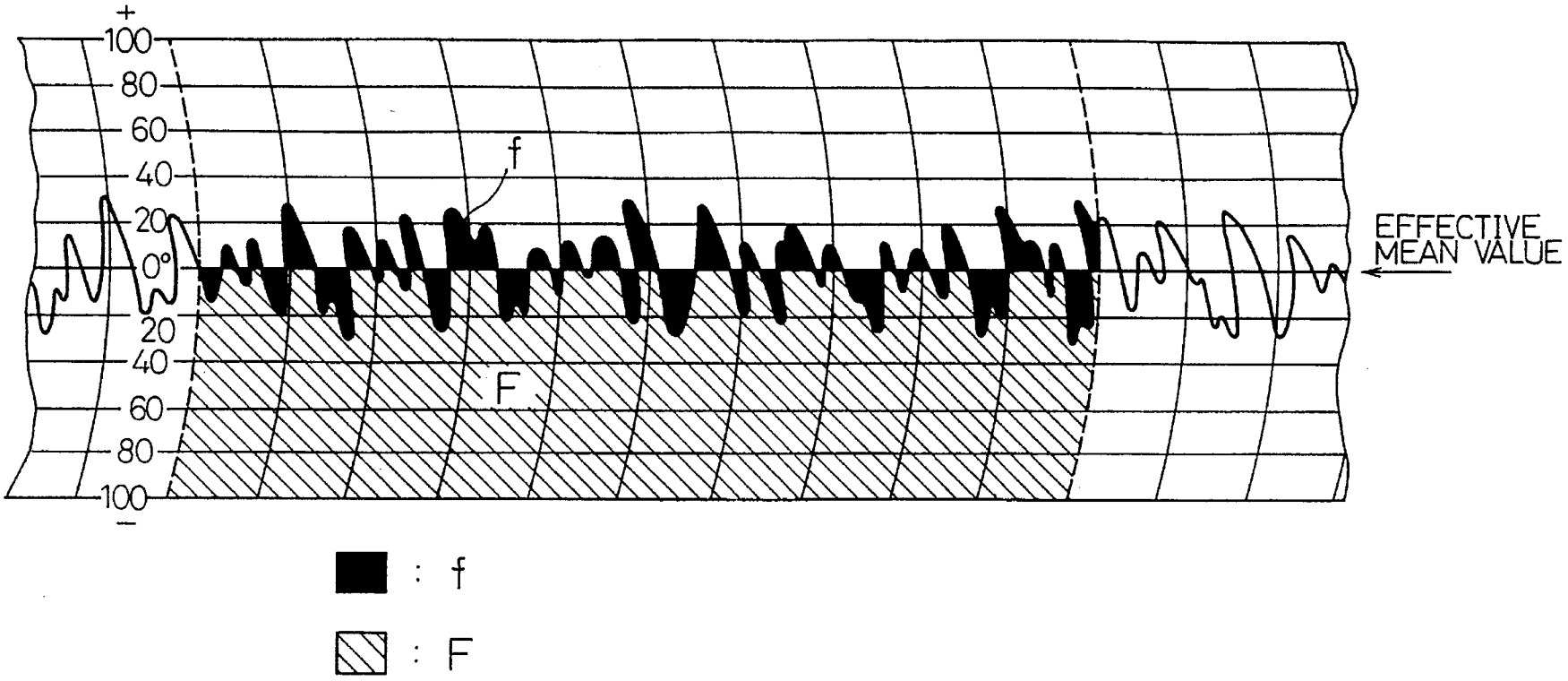
FIG. 3 is a diagram showing an evenness U% of a yarn.

The term "U%" refers to a yarn evenness value in weight and represents a linear irregularity of yarn. The U% value of the yarn is determined by using a conventional u% evenness tester. In the determination of U% (yarn evenness value), a yarn is subjected to a measurement of fluctuation in weight per unit length thereof, and the fluctuations are recorded in a diagram, for example, as shown in FIG. 3.

In the diagram, small area (f) are limited by the curve of the diagram trace and the relative and effective mean value. Also, a large area (F) is limited by the −100% line and the effective mean value of the trace. Both area are in direct reference to the same length of trace.

The yarn weight evenness value U% is defined by the following equation.

$$U\% = \frac{f}{F} \times 100$$

(4) The continuous filaments and the short fibers comprise a polyester resin, more preferably a polyethylene terephthalate resin.

(5) The composite yarn satisfies the following relationship:

$$6 \geqq dA \geqq 3,$$

$$dB < 0.8, \text{ and}$$

$$1.52 \geqq DA/DB \geqq 0.25$$

when the above-mentioned relationships are satisfied, the resultant composite yarn exhibits a super-long cotton yarn-like graceful touch.

The short fiber and continuous filament composite yarn of the present invention can be produced by the process and apparatus as described below.

The process of the present invention comprises the steps of (1) preparing a composite filament bundle comprising (a) a plurality of individual continuous filaments and (b) a plurality of other individual continuous filaments having a lower ultimate elongation than that of the individual continuous filaments (a); subjecting the composite filament bundle to a draw-cutting procedure at a draw ratio which is the same as or more than the ultimate elongation of the low elongation individual continuous filament (b), falls between an elongation at the primary yield point and 80% of the ultimate elongation of the high elongation individual continuous filaments (a) and is not more than 2.0, to cause only the low elongation continuous filaments (b) to be drawn-cut and converted to individual short fibers, (3) withdrawing the resultant draw-cut composite bundle from the draw-cutting procedure; and then (4) introducing the drawn-cut composite filament bundle into an intertwining procedure in which the drawn-cut composite filament bundle is loosened and converted to a short fiber and continuous filament composite yarn in such a manner that the high elongation individual continuous filaments (a) are gathered in an inner portion of the bundle to provide a core portion of the composite yarn, and random portions of the individual short fibers are pierced into the bundle of the individual continuous filaments and intertwined with the individual continuous filaments in the core portion and other portions of the short fibers are allowed to form a plurality of loops projecting in the form of waves, having different wave heights, from the core portion toward the outside whereof, to provide a peripheral portion of the composite yarn, which process is characterized in that in the draw-cutting procedure, the composite filament bundle is press-slid on a smooth surface of a sliding guide to cause the draw-cutting procedure to be stabilized.

The apparatus of the present invention comprises a feeding roller device rotatable at a feeding peripheral speed for feeding a composite filament bundle comprising (a) a plurality of individual continuous filaments and (b) a plurality of other individual continuous filaments having a lower ultimate elongation than that of the individual continuous filaments (a); a draw-cutting roller device for draw-cutting the low elongation individual continuous filament (b) to provide individual short fibers, which device is arranged downstream of the feeding roller device and rotatable at a higher peripheral speed than that of the feeding roller device, whereby a draw-cutting zone for the low elongation individual continuous filaments (b) is provided between the feeding roller device and the draw-cutting roller device; an intertwining device for intertwining the individual continuous filaments to convert the drawn-cut composite filament bundle to a short fiber and continuous filament composite yarn, which device is arranged downstream of the draw-cutting roller device; and a delivery roller device for delivering the resultant composite yarn, which device is arranged downstream of the intertwining device and is rotatable at a peripheral speed lower than that of the draw-cutting roller device, which apparatus is characterized by a sliding guide arranged along the path of the composite filament bundle in the draw-cutting zone and having a smooth surface thereof which causes the composite filament bundle to be press-slid thereon.

Compared with conventional spun yarn composed of only short fibers, the short fiber and continuous filament composite yarn are advantages in that a high stiffness and resilience of the continuous filaments having a relatively large thickness (denier) can be effectively utilized, and a deterioration of the soft touch due to the exposure of the continuous filaments to the outside of the composite yarn is small. Also, in comparison with conventional multifilament yarn, the short fiber and continuous filament composite yarn is advantageous in that since the continuous filaments having a relatively small thickness (denier) are drawn-cut and converted to short fibers, the resultant composite yarn is provided with a plurality of fluffs and has a fluctuating thickness, and thus exhibits an improved natural fiber spun yarn-like appearance and touch.

Also, composed with a customary spinning process, a draw-cut, non-twist, intertwine spinning process is advantageous in that drawn-cut fibers having a relatively large length can be utilized, a complicated thermal shrinkage distribution can be imparted to the resultant spun yarn, the processing speed is very high, and the resultant spun yarn has an improved touch and productively.

In consideration of the above-mentioned advantages, the inventors of the present invention attempted to produce the short fiber and continuous filament composite yarn by the draw-cut, non-twist, intertwine-spinning process. During this attempt, it became clear that the production of the short fiber and continuous filament composite yarn by the draw-cut, non-twist, intertwine-spinning process is disadvantageous in that the resultant yarn is uneven in thickness, has a number of defects, and breaks often occurs in the spinning process. Namely, although many patent applications for this process have been filed, the practical production of the short fiber and continuous filament composite yarn by the draw-cut, non-twist, intertwine-spinning process was very difficult, and thus has not yet reached a level enabling a practical production of commercial products.

The reasons for this difficulty are considered to be as follows.

In production of a composite yarn having the same denier as that of a certain spun yarn composed of short fibers, by joining the same short fibers as in the spun yarn with continuous filaments, the total number of the short fibers in the composite yarn must be less than that in the spun yarn. The decreased number of the short fibers results in a lower degree of bundling of the short fibers with each other. Therefore, the degree of bundling of the short fibers is easily influenced by the air resistance against the movement of the short fibers, the air streams accompanying the rotation of the nip rollers, resilient shocks on the short fibers due to the draw-cutting, and a static force.

Especially, where the continuous filaments to be drawn-cut have a relatively large denier, the continuous filaments must be drawn-cut at a high draw ratio. Therefore, even a slight fluctuation in the speed of the continuous filaments to be drawn-cut will vary the total number of filaments and fibers nipped by a pair of draw-cutting nip rollers, and thus the resultant composite yarn will have an uneven thickness and be frequently broken. Also, where the continuous filaments to be drawn-cut have a relatively small denier, the continuous filaments can be drawn-cut at a relatively low draw ratio, and travelled at an increased speed. Therefore, the production of the composite yarn is greatly influenced by an uneven resistance of air against the movement of the filaments and an uneven lapping action of the feeding rollers, and the resultant composite yarn has an increased uneven thickness and a number of defects, and often breaks. Also, the production of the composite yarn is influenced by the orientation and bundling property of the continuous filaments to be converted thereto, the amount of oiling agent applied thereto, and tensile strength, ultimate elongation, and uniformity of the continuous filaments.

After various attempts, the inventors of the present invention found that, where a composite filament bundle comprising (a) a plurality of individual continuous filaments having a relatively high ultimate elongation and preferably a relatively large denier and (b) a plurality of individual continuous filaments having a lower ultimate elongation and preferably a smaller denier than those of the continuous filaments (a), is subjected to a draw-cutting procedure at a draw ratio at which only the low elongation individual continuous filaments (b) are selectively drawn-cut, the high elongation individual continuous filaments (a) are not drawn-cut and the low elongation individual continuous filaments can be selectively and stably drawn-cut and converted to individual short fibers at a surprisingly high evenness and efficiency by bringing the composite filament bundle into contact with a smooth surface of a sliding guide on which the composite filament bundle is press-slid, so that the resultant drawn-cut short fibers are stably held between the smooth surface of the sliding guide and the non-cut continuous filaments.

The smoothness and uniformity of the draw-cutting procedure can be further enhanced by bending the composite filament bundle in the draw-cutting procedure, to open the composite filament bundle.

When the composite filament bundle is bent around a bending guide roll and press-slid on the bending guide roll, the individual filaments (a) and (b) in the bundle are released from adhesion, entanglements, and constriction with each other and are uniformly drawn without a mutual interference between the filaments. Also, the low elongation continuous filaments (b) are evenly mixed with the high elongation continuous filaments (a), and thus the resultant draw-cut short fibers are stably embraced and held by the non-cut continuous filaments.

Therefore, the travel of the drawn-cut short fibers is less influenced by the resistance of air and the air streams generated by the rotation of the draw-cutting rollers, and the resultant draw-cut composite filament bundle can be stably traveled.

When the composite filament bundle is press-slid on the flat smooth surface of the sliding guide plate in the draw-cutting procedure, the resultant drawn-cut short fibers are interposed between the non-cut continuous filaments and the flat smooth surface and allowed to stably travel without any influence from the resistance of air and the air streams accompaning the rotation of the draw-cutting rollers.

If the composite filament bundle is oiled with an oiling agent, for enhancing the antistatic property of the bundle and reducing the bundling property of the individual filaments, the above-mentioned bending procedure for the composite filament bundle is not always necessary.

Figure 4:
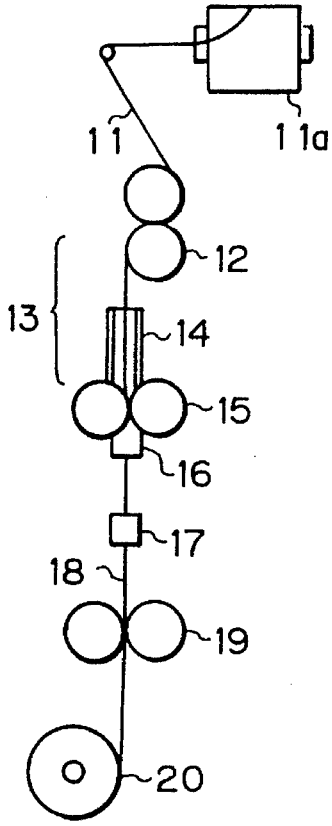
FIG. 4 is an explanatory side view of a conventional apparatus for producing a composite yarn.
Figure 5:
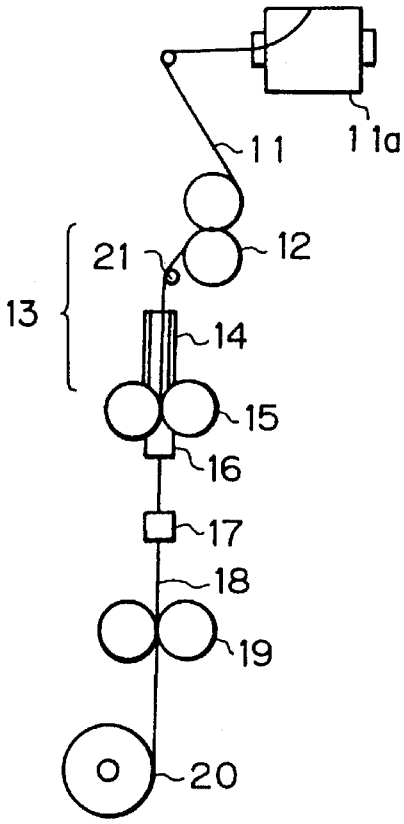
FIG. 5 is an explanatory side view of another conventional apparatus for producing a composite yarn.

FIGS. 4 and 5 respectively show an apparatus for carrying out a conventional draw-cut, non-twist-spinning process.

Referring to FIG. 4, a filament bundle 11 is withdrawn from a bobbin 11*a* by a pair of feeding rollers 12 and introduced into a draw-cutting zone 13. In the cutting zone 13, the filament bundle 11 travels through a non-contact shooter 14 and is drawn-cut by the draw-cutting rollers 15.

The peripheral speed of the draw-cutting rollers 15 is higher than that of the feeding rollers 12. The resultant drawn-cut filament bundle is passed through a nozzle 16 for withdrawing the drawn-cut composite filament bundle and an intertwining device 17 for intertwining the short fibers with the continuous filaments, and then the resultant short fiber and continuous filament composite yarn 18 is delivered through a pair of delivery rollers 19 and wound around a bobbin 20.

The nozzle 16 is preferably an air-circling and sucking nozzle. The intertwining device 17 comprises an air-circling nozzle, an interlacing nozzle, or a nozzle having the functions of the above-mentioned two types of nozzles.

Referring to FIG. 5, the conventional process employs a bending guide roll 21 which is non-rotatable or rotatable at a lower peripheral speed than the travelling speed of the filament bundle 11, to cause the filament bundle 11 travelling in the draw-cutting zone 13 to be bent around and slid on the guide roll 21 and thus opened. This opening action is effective for evenly mixing the individual filaments with each other.

Figure 6:
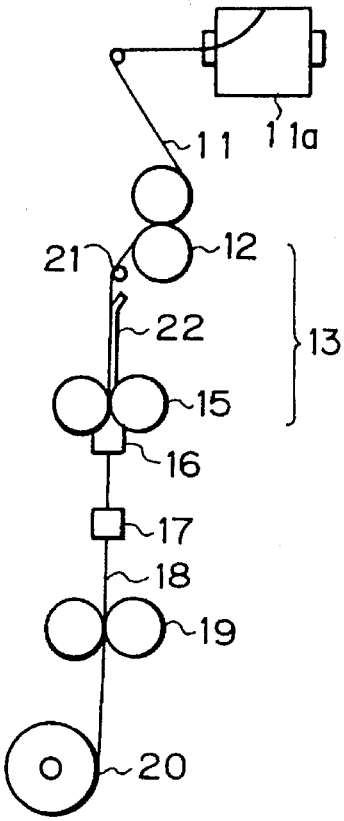
FIG. 6 is an explanatory side view of an embodiment of the apparatus of the present invention.

FIG. 6 shows an apparatus for effecting the process of the present invention for producing a short fiber and continuous filament composite yarn.

Referring to FIG. 6, in the draw-cutting zone 13, a bending guide roll 21 for bending the path of the composite filament bundle 11 and opening the bundle 11 is arranged downstream of the feeding rollers 12. The bending guide roll 21 is non-rotatable or rotatable at a lower peripheral speed than the travelling speed of the composite filament bundle 11, and causes the composite filament bundle 11 to slide and to be opened thereon. Also, a sliding guide plate 22 having a flat smooth sliding surface is arranged between the bending guide roll 21 and the draw-cutting rollers 15. The flat smooth sliding surface of the guide plate 22 is located along the path of the composite filament bundle 11 in the draw-cutting zone 13, so as to cause the composite filament bundle 11 to be press-slid thereon under tension.

For example, a composite filament bundle was prepared by doubling a filament bundle having a total denier of 18.4 and composed of four high elongation individual polyester continuous filaments (a) having a denier of 4.6, an ultimate elongation of 75% with a filament bundle having a total denier of 40 and composed of 80 low elongation individual polyester continuous filaments (b) having a denier of 0.5 and an ultimate elongation of 20%, and joining three of the doubled filament bundles together in parallel to each other (without twisting).

The composite filament bundle was converted to a short fiber and continuous filament composite yarn by each of the apparatuses of FIGS. 4, 5, and 6. In each apparatus, the composite filament bundle was fed at a feed speed of 400 m/min and drawn at a draw ratio of 1.3 and a draw-cutting length of 28 cm, to selectively draw-cut the low elongation individual filaments (b). In the intertwining device 17, the drawn-cut composite filament bundle was loosened at an overfeed of 5%. This intertwining device 17 comprised an air-circling nozzle.

The resultant short fiber and continuous filament composite yarns produced by the apparatuses of FIGS. 4, 5, and 6 had the processing properties and the physical properties as shown in Table 1.

TABLE 1

| Item | Type of apparatus | | |
|---|---|---|---|
| | Apparatus of FIG. 4 (prior art) | Apparatus of FIG. 5 (prior art) | Apparatus of FIG. 6 (the present invention) |
| Physical property | | | |
| Total denier (d) | 138 | 138 | 138 |
| U % (%) | 17.7 | 12.3 | 3.9 |
| No. of thin portions per 150 m of yarn | 20 | 6 | 0 |
| No. of thick portions per 150 m of yarn | 12 | 4 | 0 |
| No. of neps per 150 m of yarn | 173 | 35 | 0 |
| Appearance (*)1 | Many thin and thick slub yarn-like stripes appeared | Many thin and thick slub yarn-like stripes and neps appeared | Uniform and satisfactory |

TABLE 1-continued

| Item | Type of apparatus | | |
|---|---|---|---|
| | Apparatus of FIG. 4 (prior art) | Apparatus of FIG. 5 (prior art) | Apparatus of FIG. 6 (the present invention) |
| Processing property | | | |
| No. of yarn breakages per day | 189 | 142 | 0.9 |
| Cause of yarn breakage | Uneven draw-cutting | Uneven draw-cutting | Contamination with fluffs |

Note:
(*)1 . . . The appearance of a tubular knitted fabric made from the composite yarn.

Table 1 clearly shows that the short fiber and continuous filament composite yarn produced by the process and apparatus of the present invention exhibited a very small U% and a small number of defects (thin and thick portions and neps). Also, it was confirmed that the number of yarn breakages in the process and apparatus of the present invention is very low.

Also, the above-mentioned composite yarn produced by the process and apparatus (FIG. 6) of the present invention had a value of $U \cdot N^{1/2}$ of 61.5, which is significantly smaller than the $U \cdot N^{1/2}$ value of 104 to 128 of customary spun yarns, and thus exhibited a surprisingly high evenness in thickness of the yarn.

Accordingly, the process and apparatus of the present invention is useful for producing short fiber and continuous filament composite yarns having a high quality, at a high productivity.

Figure 7:
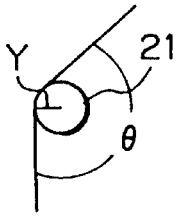
FIG. 7 shows a bending angle of a yarn bent by a guide roll usable for the present invention.

In the process of the present invention, the bending guide is preferably in the form of a roll having a curvature radius of 10 mm or less. Also, the composite filament bundle is bent preferably at a bending angle of 160 degrees or less around the bending guide, as indicated in FIG. 7.

If the curvature radius of the bending guide roll is more than 10 mm and/or the bending angle is more than 160 degrees, the opening effect of the bending roll for the composite filament bundle becomes unsatisfactory. The bending guide roll is arranged at any location between the feeding roller device and the sliding guide plate. The bending guide may be in the form of a bar or roll or a plate. Also, the bending guide is preferably made from an abrasion-resistant material, for example, ceramics, sapphire ruby, and rigid treated metallic materials. If the path of the composite filament bundle on the bending guide is movable, however, to prevent a limited portion of the bending guide from being always abraded by the composite filament bundle, the materials for the bending guide are not restricted to the abrasion-resistant materials.

Figure 8:
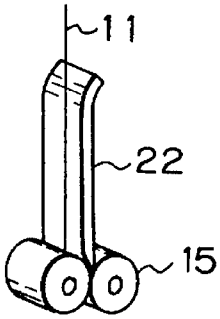
FIG. 8 is a perspective view of a flat surface sliding guide plate usable for the present invention.

The sliding guide plate is arranged so that a downstream end thereof is located close to the nip point of the feeding roller device as indicated in FIG. 8. The composite filament bundle 11 is lightly press-slid on the flat smooth surface of the sliding guide plate 22 arranged upstream of the draw-cutting roller device 15. There is no limitation to the form of the sliding guide and the angle at which the composite filament bundle comes into contact with the sliding guide. The sliding guide may be in the form of a flat plate, a curved plate, a pipe, or groove-formed plate. The surface of the sliding guide for press-sliding the composite filament bundle thereon must be smooth and is preferably made from an abrasion resistant and antistatic material, for example, a satinized metallic material, ceramic-coated metallic material or a ceramic material. The sliding guide is effective for interposing and holding the drawn-cut short fibers between the sliding guide surface and the non-cut continuous filaments and for preventing an undesirable separation of the short fibers from the composite filament bundle and a dishevelling of the short fibers.

A draw-cutting length of the composite filament bundle will be explained below.

In the process of the present invention, the composite filament bundle comprising the high elongation individual continuous filaments (a) and the low elongation individual continuous filaments (b) is subjected to a drawn-cutting procedure and only the low elongation individual continuous filaments (b) are selectively draw-cut at a draw ratio between the high and low ultimate elongations of the high and low elongation individual continuous filaments. Accordingly, the draw ratio is about 2.0 or less, which is significantly lower than the draw ratio of 10 to 30 in the conventional draw-cut, non-twist-spinning process.

Therefore, in the process of the present invention, the composite filament bundle is fed at a much higher feed speed through the feeding roller device than that in the conventional process.

It was found that this high feeding speed caused the average length of the draw-cut short fibers to be larger than that in the conventional process.

For example, a secondary filament bundle was prepared by joining primary filament bundles of 64 denier/144 filaments and having an ultimate elongation of 18%. The total denier of the secondary filament bundle was adjusted so that when the secondary filament bundle is fed at the feeding speed of 400 m/min and draw-cut at the draw ratio and the draw-cutting length as indicated in Table 2 in the apparatus of FIG. 6, the resultant drawn-cut fiber bundle has a total denier of 130. Table 2 also shows the total denier of the secondary filament bundle before draw-cutting, and the average fiber length of the resultant drawn-cut fibers.

TABLE 2

| Run No. | 1 | 2 | 3 | 4 |
|---|---|---|---|---|
| Draw ratio | 1.3 | 15 | 1.3 | 15 |
| Draw-cutting length (cm) | 30 | 30 | 50 | 100 |
| Total denier of secondary filament bundle | 148 | 145 | 146 | 145 |
| Average length of drawn-cut fibers | 37 | 13 | 48 | 46 |

Surprisingly, when the draw-cutting procedure is carried out at a high speed and at a low draw ratio, sometimes the average length of the drawn-cut fibers is longer than the draw cutting length.

Preferably the average length of the drawn-cut fibers is 50 cm or less, more preferably 30 cm or less, and the draw-cutting length is about 50 cm or less, more preferably 30 cm or less.

Figure 9:
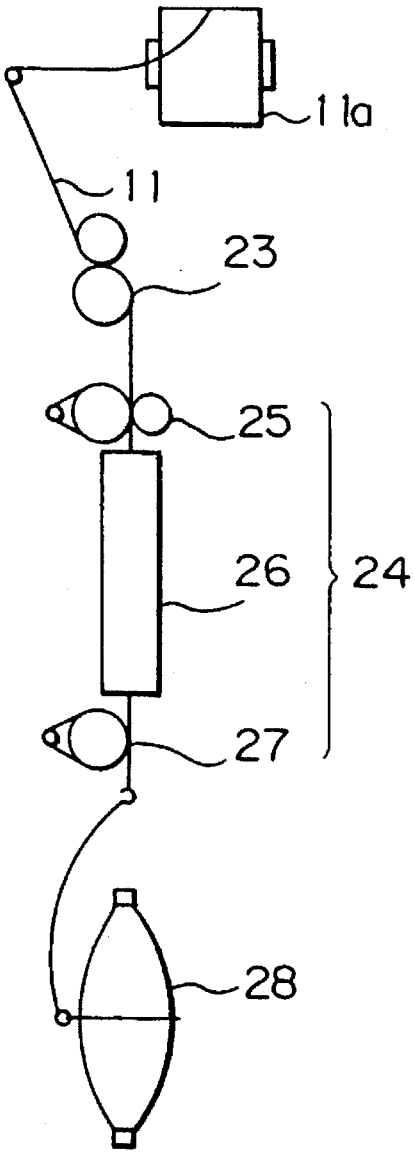
Fig. 9 PRIOR ART
FIG. 9 shows a conventional apparatus for drawing a filament yarn.
Figure 10:
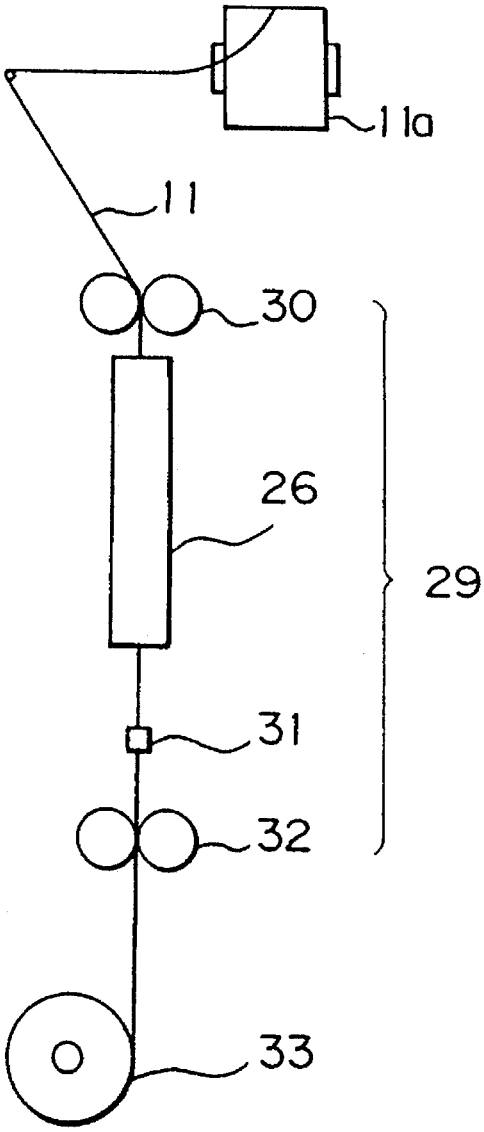
Fig. 10 PRIOR ART
FIG. 10 shows a conventional apparatus for draw-false twisting a filament yarn.

If a conventional heat drawing apparatus as shown in FIG. 9 or a conventional heat draw, false twisting apparatus as shown in FIG. 10, which has a large draw-cutting length, is employed for the production of draw-cut fibers under the same condition as mentioned above, the resultant draw-cut fibers will have a very large average length and pitch of unevenness. Also the resultant draw-cut fiber yarn will exhibit a filament yarn-like unnatural appearance.

In the heat drawing apparatus of FIG. 9, a filament bundle 11 is withdrawn from a bobbin 11*a* by a pair of nip rollers 23 and fed into a drawing zone 24 through a feeding roller device 25. In the drawing zone 24, the filament bundle is heated by a heater 26 and drawn by a drawing roller device 27. The drawn filament bundle is wound up around a bobbin 28.

In the heat draw, false-twisting apparatus of FIG. 10, a filament bundle 11 is withdrawn from a bobbin 11*a* and fed into a heat draw, false-twisting zone 29 comprising a heater 26, a false-twist spinner 31 and a drawing roller device 32 through a feeding roller device 30. In the heat draw, false twisting zone 29, the filament bundle 11 is heated in the heater 26 and false-twisted by the false twist spinner 31, while being drawn by the drawing roller device 32. The drawn, false-twisted filament bundle is wound around a bobbin 33.

In the process of the present invention, the composite filament bundle is provided from a plurality of high elongation individual continuous filaments (a) and a plurality of the low elongation individual continuous filaments (b), by a customary method.

For example, in the preparation of the composite filament bundle, at least one bundle composed of a plurality of high elongation individual continuous filaments is joined with at least one bundle composed of a plurality of low elongation individual continuous filaments, without twisting.

In another example, in the preparation of the composite filament bundle, a fiber forming polymer material, for example, a polyester resin is melt-extruded through a spinneret having a plurality of extrusion holes having a predetermined diameter and land length for forming high elongation individual continuous filaments and a plurality of other extrusion holes having a diameter different than that of those mentioned above and a land length longer than that of those mentioned above, for forming low elongation individual continuous filaments, and the resultant undrawn multifilament bundle is drawn and optionally heat treated.

Then the low elongation individual continuous filaments (b) in the above-mentioned composite filament bundle are evenly drawn-cut and intertwined with the high elongation individual continuous filaments (b) under less disturbance, for example, air resistance. Therefore, random portions of the drawn-cut short fibers are pierced into the core portion substantially composed of the high elongation individual continuous filaments (a) and intertwined with the individual filaments (a) and other portions of the short fibers to allow the forming of a plurality of loops projecting in the form of waves from the core portion toward the outside of the core portion, to thus form a peripheral portion of the composite yarn. Some of the free end portions of the short fibers are projected from the core portion or wound around the core portion. The loops have various and different wave heights. In the peripheral portion, the short fibers are substantially evenly distributed and form a multilayer structure of the loops. Also, the core portion is completely covered by the peripheral portion comprising the short fibers.

The cold-drawn high elongation individual continuous filaments (a) have a low orientation and a high thermal shrinkage.

The cold drawn-cut short fibers have a higher orientation and lower thermal shrinkage than those of the individual continuous filaments (a). Also the thermal shrinkage of the cold drawn-cut short fiber varies along the longitudinal axes thereof. Accordingly, the cold drawn individual continuous filaments (a) form a core portion having a high resilience and the cold drawn-cut short fibers form a multilayered peripheral portion having a soft touch and a good bulkiness.

The resultant composite yarn has a latent thermal shrinking capability of the short fiber varying along the longitudinal axis thereof, and exhibits both a soft touch and high resilience and a uniform natural fiber spun yarn-like appearance.

Table 3 shows examples of relationships among the denier (dA) of the individual continuous filaments and the denier (dB) of the short fibers in the composite yarn, the ratio dA/dB, the touch, and resilience of the resultant composite yarn and the draw-cutting property of the composite filament bundle.

TABLE 3

| $dA_{(d)}$ | dB | dA/dB | Touch | Resilience | Draw-cutting property |
|---|---|---|---|---|---|
| 4.2 | 0.4 | 10.5 | High grade cotton yarn-like | Good | Good |
| 4.2 | 0.8 | 4.7 | High grade cotton yarn-like | " | " |
| 4.2 | 1.3 | 3.2 | Good | " | " |
| 4.2 | 1.9 | 2.2 | Satisfactory | " | " |
| 4.2 | 2.4 | 1.8 | Unsatisfactory | " | " |
| 4.2 | 3.0 | 1.4 | " | " | " |
| 5.0 | 2.4 | 2.1 | " | " | " |
| 6.0 | 2.4 | 2.5 | " | " | " |
| 1.3 | 0.9 | 1.4 | Good | Unsatisfactory | (*)2 |
| 2.4 | 1.3 | 1.8 | Good | Satisfactory | (*)2 |

Note:
(*)2 . . . Fluffs were formed from high elongation filaments.

To obtain a soft touch, the short fibers preferably have a small denier of 2 or less. When the short fibers have a very small denier of 0.8 or less, the resultant composite yarn exhibits a soft touch like that of a high grade cotton spun yarn, made from, for example, Sea island cotton or Supima cotton.

To obtain a composite yarn having an excellent touch and resilience, the control of the ratio dA/dB is important. That is, the ratio dA/dB is preferably 2 or more.

Further, to improve the touch, the control of the ratio DA/DB wherein DA is a total denier of the individual continuous filaments and DB is a total denier of the short fibers, is important. Preferably, the ratio DA/DB is 3.3 or less but not less than 0.3 ($3.3 \geqq DA/DB \geqq 0.3$)

Table 4 shows relationships among DA, DB and DA/DB and the touch of the resultant composite yarn.

TABLE 4

| DA | DB | DA + DB | DA/DB | Touch (*)3 | Remarks |
|---|---|---|---|---|---|
| 120 | 10 | 130 | 12.0 | Very rough and stiff | |
| 110 | 20 | 130 | 5.50 | Rough and stiff | |
| 100 | 30 | 130 | 3.33 | Not sufficiently soft touch | Satisfactory |
| 60 | 70 | 130 | 0.86 | Good | |
| 40 | 90 | 130 | 0.44 | Good | |
| 30 | 100 | 130 | 0.30 | Not sufficient resilience | |
| 20 | 110 | 130 | 0.18 | Very limp | Insufficient resilience |

Note:
dA = 4.2 d
dB = 0.4 d
(*)3 . . . The touch was organoleptically evaluated on a tubular knitted fabric made from the composite yarn and treated with boiling water for ___ minutes.

In the production of the short fiber and continuous filament composite yarn of the present invention, it is important that the composite filament bundle be fully opened and the low elongation individual continuous filaments (b) be randomly drawn-cut. Accordingly, Preferably the composite filament bundle subjected to the process of the present invention is preliminarily imparted with a high opening capability and able to randomly drawn-cut.

For maintaining a number of individual filaments in the composite filament bundle in a well-ordered bundle form, effectively the composite filament bundle are pre-treated with an oiling agent comprising an antistatic compound in the state of a solid at room temperature and the individual filaments are lightly entangled with each other at an entanglement number of 10 or less per m.

In accordance with the results of the study of the inventors of the present invention, it was made clear that the conventional manner of forming structural defects in the individual filaments does not sufficiently enhance the random draw-cutting property of the individual filaments, and the bundling property of the individual filaments must be reduced to a lower level than that of conventional multifilaments by reducing the mutual constriction of the individual filaments.

In the process of the present invention, the composite filament bundle must be in the form of a well-ordered bundle until passed through the feeding roller device of the draw-cutting apparatus, and thereafter, must be easily opened and the low elongation individual continuous filaments must be randomly drawn-cut.

Accordingly, the oiling agent preferably contains 70% by weight or more of at least one antistatic compound selected from potassium alkylphosphates having an alkyl group with an average carbon atom number of 12 to 18 and alkali metal salts of fatty acids having an alkyl group with an average carbon atom number of 8 to 18. As long as the objects of the present invention are not hindered, the oiling agent can contain at least one additional member selected from surfactants, higher fatty acids, aliphatic polycarboxylic acids, aromatic carboxylic acids, esters of sulfur-containing aliphatic carboxylic acids with higher alcohols or polyalcohols, lubricants comprising, for example, an inorganic substance, and an emulsion-controlling agent comprising, for example, a fatty acid or alcohol, which are already known as fiber-treating agents. In the application of the oiling or fiber-treating agents, it is important that the oiling or fiber-treating agents be evenly imparted to the composite filament bundle. When the oiling or fiber-treating agent is applied to the individual filaments, the resultant individual filaments are easily bundled without an undesirable winding of the individual filaments around the rotating rollers, an accumulation of a scum on rollers or guide members, and a contamination by the scum of the bundle.

When the conventional oiling agent is applied to the individual filaments and dried, however, the oiling agent layers on the individual filaments easily absorb atmospheric moisture and exhibit an increased adhering property, and therefore, the individual filaments are adhered to each other and strongly bundled. This type of composite filament bundle cannot be randomly drawn-cut.

Surprisingly, it was found that, when the oiling agent layers on the individual filaments are absolutely dried, the absolutely dried oiling agent layers exhibit a much lower adhesion and are maintained in the state of a solid at room temperature.

Accordingly, after absolute drying, the oiling agent-treated individual filaments are easily opened and can be randomly drawn-cut without difficulty.

Further, it was found that, when a light impact action, for example, a rubbing or sliding action, is applied to the oiling agent-treated filaments, the absolutely dried oiling agent layers on the individual filaments are easily broken or divided, and thus the opening property of the individual filaments is further enhanced.

As mentioned above, the individual filaments in the composite filament yarn are preferably lightly entangled at an entanglement number of 10 or less per m by using an air nozzle. If the entanglement number is more than 10 per m, even if the oiling agent is applied, a draw-cutting force is concentrated in the entangled portions of the individual filaments and the individual filaments are drawn-cut at the entangled portions thereof. The stability of the entanglements of the individual filament is preferably as high as possible, and therefore, the air nozzle should be arranged at a location at which any fluctuation in the tension applied to the composite filament bundle is small. As stated above, when the application of the oiling agent and the light entanglement of the individual filaments are well balanced, the bundling property of the individual filaments is effectively reduced and the low elongation individual continuous filaments can be drawn-cut at random.

The composite filament bundle usable for the process of the present invention is preferably prepared from at least one filament bundle (A) composed of high elongation individual filaments (a) and at least one other filament bundle (B) composed of low elongation individual filaments (b) which satisfy the following relationships:

$$dA/dB \geqq 2,$$

$$dB < 2$$

$$3.3 \geqq DA/DB \geqq 0.3,$$

the difference in ultimate elongation between the high and low elongation individual continuous filaments being 20% or more, and the individual filaments are entirely coated with an oiling agent comprising an antistatic compound, which is in the state of a solid at room temperature, in an amount of 0.1 to 0.5% by weight (OPU) and are lightly entangled at an entanglement number of 10 per m.

In the above-mentioned composite filament bundle, most preferably the low elongation, small denier individual continuous filaments (b) have an average ultimate elongation of 35% or less. When the average ultimate elongation is 35% or less, the low elongation small denier individual continuous filaments (b) in the composite filament bundle can be drawn-cut without difficulty.

The entanglement number of the individual filaments is determined by floating a filament bundle having a length of 50 cm in water at a temperature of 50° C. for 30 seconds, and counting the number of entanglements of the individual filaments in the bundle. This measurement is repeated five times.

The entanglement number is indicated by the average number of entanglements per m of the bundle.

The amount of the oiling agent (OPU) on the individual filaments based on the weight of the individual filaments is measured in accordance with a customary deflection method.

The tensile strength of the composite filament bundle or the composite yarn is measured at a testing length of 20 cm at a stretching rate of 100%/min at room temperature by using a tensile tester available under the trademark of Tensilon UTM-111, made by Orientec.

In the draw-cutting procedure, the low elongation individual continuous filaments (b) in the composite filament bundle must be selectively drawn-cut without cutting the high elongation individual continuous filaments (a). Accordingly, the ultimate elongation of the low elongation individual filaments (b) must be significantly lower than that of the high elongation individual filament (a). In a practical draw-cutting procedure, however, when the individual filaments (a) and (b) both have a circular cross-sectional profile, the difference in the ultimate elongation of the individual filaments (a) and (b) is not sufficiently large, and thus the selective draw-cutting of the low elongation individual filaments (b) is difficult. Therefore, preferably the low elongation individual filaments (b) have a multilobal cross-sectional profile, as the multilobal cross-sectional profile causes the resultant individual filaments to have an increased peripheral surface area thereof, and the increased peripheral surface area causes the crystallization rate of the individual filaments to be increased, and thus the resultant individual filaments exhibit a lowered ultimate elongation.

In the above-mentioned type of the composite filament bundle, preferably the ratio DA/DB is from 2 to 7, the low elongation small denier individual filaments (b) have a multilobal cross-sectional profile, and the difference in ultimate elongation between the high and low elongation individual filaments (a) and (b) is 20% or more.

Also, the low elongation small denier individual filaments (b) should satisfy the following relationship:

$$R/Y \geqq 2.5$$

wherein R represents a radius of a circumcircle of the multilobal cross-sectional profile of the filament (b) and Y represents a radius of an inscribed circle of the multilobal cross-sectional profile. The ratio R/Y indicates a degree of irregularity of the cross-sectional profile.

The low and high elongation individual filaments (a) and (b) are prepared by melt-spinning a fiber-forming polymer, for example, a polyester resin, preferably by a superhigh speed spinning method at a spinning speed of 5000 m/min or by a high speed spinning method at a spinning speed of 2500 to 5000 m/min, drawing the melt-spun filaments and heat-treating the drawn filaments. The difference in ultimate elongation between the low and high elongation individual filaments (a) and (b) is preferably 20% or more, and the low elongation individual filaments (b) have an ultimate elongation of 30%.

In the short fiber and continuous filament composite yarn of the present invention, the continuous filaments and the short fibers preferably comprise a polyester resin. The polyester resin is preferably selected from a polyesterification product of a dicarboxylic component comprising terephthalic acid with a glycol component comprising at least one alkylene glycol, for example, selected from ethyleneglycol, trimethyleneglycol, and tetramethyleneglycol.

Namely, the polyester resin is preferably selected from polyethyleneterephthalate, polybutyleneterephthalate, polyethylenenaphthalate, polyhexamethyleneterephthalate, isophthalate-terephthalate copolymers corresponding to the above-mentioned terephthalate polymers, and mixtures of two or more of the above-mentioned polymers and copolymers.

The polyester resin may contain a customary additive, for example, delustering agent, stabilizing agent, and antistatic agent.

There is no limitation on the total denier of the composite filament bundle to be subjected to the draw-cutting procedure, but preferably the total denier of the composite filament bundle is 3000 or less, more preferably 100 to 500, the total denier DA of the high elongation filament bundle is 20 to 400, and the total denier DB of the low elongation filament bundle is 20 to 400.

In the apparatus of the present invention, a draw-cutting zone is provided between a feeding roller device and a draw-cutting roller device. There is no limitation on the type of the feeding roller device and the draw-cutting roller device.

Referring to each of FIGS. 11 to 15, a composite filament bundle 41 is drawn-cut in a draw-cutting zone formed between a feeding roller device 43 and a draw-cutting roller device 44 which rotates at a higher peripheral speed than that of the feeding roller device, and having a sliding guide arranged close to the draw-cutting roller device.

Figure 11:
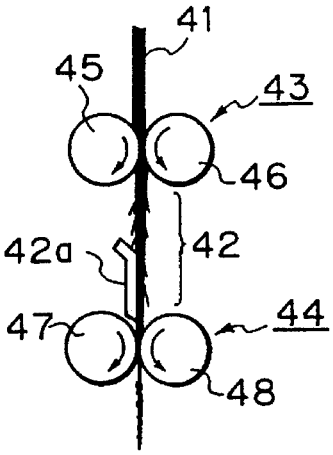
FIGS. 11 to 15 are side views of embodiments of the arrangement of the feeding roller device and the draw-cutting roller device usable for the present invention.

In FIG. 11, the feeding roller device 43 is a pair of nip rollers composed of a metallic roller 45 and a rubber roller 46. Also, the draw-cutting roller device 44 is a pair of nip rollers composed of a metallic roller 47 and a rubber roller 48. Those rollers are rotatable in the directions indicated by arrows. A sliding guide **42*a* is arranged between the feeding roller device 43 and the draw-cutting roller device 44**.

Figure 12:
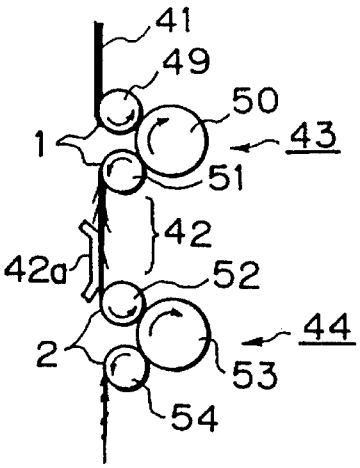

In FIG. 12, the feeding roller device 43 is composed of a metallic roller 49, a rubber roller 50, and a metallic roller 51, successively combined with each other and rotating in the directions shown by arrows, and the draw-cutting roller device 44 is composed of a metallic roller 52, a rubber roller 53, and a metallic roller 54, successively combined with each other and rotatable in the directions indicated by arrows.

In each of the feeding and draw-cutting roller devices of FIGS. 11 and 12, each metallic roller is pressed against a rubber roller under a linear nip pressure of from several tens of kgs to several hundreds of kgs.

Figure 13:
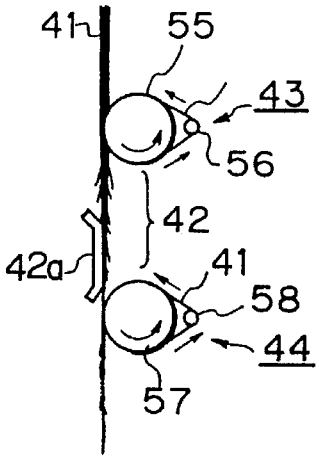

In FIG. 13, the feeding roller device 43 is composed of a thick roller 55 and a thin roller 56, and the draw-cutting roller device 44 is composed of a thick roller 57 and a thin roller 58. The composite filament bundle 41 is wound in a plurality of turns around the thin and thick rollers, as indicated in the drawing.

Figure 14:
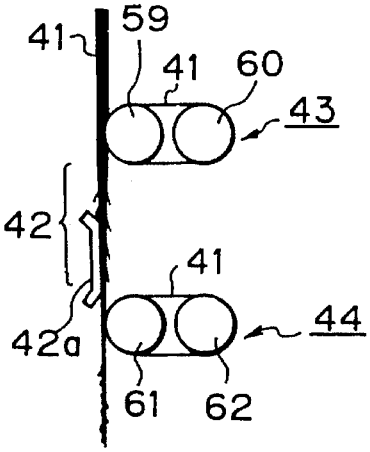

In FIG. 14, the feeding roller device 43 is composed of a pair of rollers having the same diameter, and the draw-cutting roller device 44 is composed of a pair rollers 61 and 62 having the same diameter. The composite filament bundle 41 is wound in a plurality of turns around the pair of rollers, as shown in the drawing.

Figure 15:
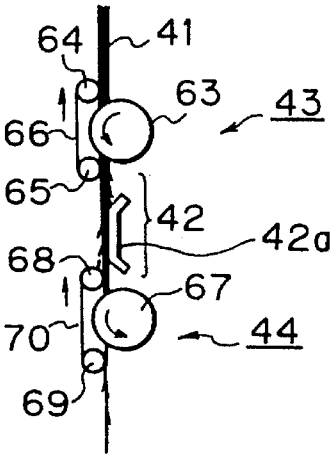

In FIG. 15, the feeding roller device 43 is composed of a main roller 63 and a pair of rollers 64 and 65 and an endless apron belt 66 which travels along a path defined by the rollers 64 and 65, and the draw-cutting roller device 44 is composed of a main roller 67 and a pair of rollers 68 and 69 and an endless apron belt 70 which travels along a path defined by the rollers 68 and 69. The composite filament bundle is interposed and pressed between the main roller 63 or 67 and the endless apron belt 66 or 70.

Figure 16:
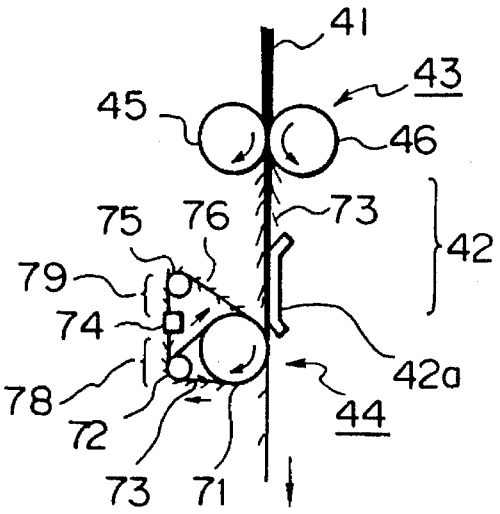
FIG. 16 is a side view of an embodiment of the arrangement of the feeding roll device, the draw-cutting roller device, and the false-twisting device usable for the present invention.
Figure 17:
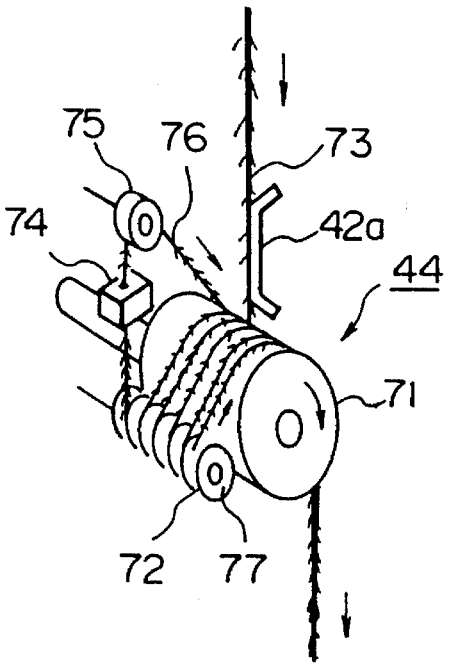
FIG. 17 is a perspective view of the arrangement of the draw-cutting roller device and the false twisting device as shown in FIG. 16 usable for the present invention.
Figure 18:
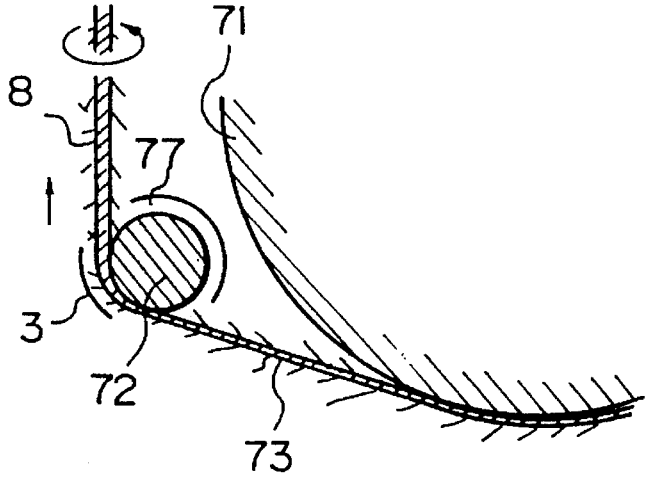
FIG. 18 is an explanatory view of a composite filament bundle false-twisted by the false-twisting device as shown in FIGS. 16 and 17, in accordance with the present invention.

FIGS. 16, 17, and 18 show a preferable embodiment of the draw-cutting zone 42 formed between a feeding roller device 43 and a draw-cutting roller device 44.

In FIGS. 16, 17, and 18, a composite filament bundle 41 is introduced into the draw-cutting zone 42 through a feeding roller device 43, and the low elongation individual filaments (b) in the composite filament bundle 41 are drawn-cut to convert the composite filament bundle 41 to a drawn-cut composite filament bundle 73.

Referring to FIG. 16, the feeding roller device 43 is composed of a pair of nip rollers consisting of a metallic roller 45 and a rubber roller 46.

Referring to FIGS. 16 and 17, the draw-cutting roller device 44 is composed of a first roller 71 for receiving the draw-cut composite filament bundle 73 thereon and a second roller 72 spaced from and arranged in parallel to the first roller, whereby a path of the draw-cut composite filament bundle 73 is provided around the first and second rollers 71 and 72 as indicated in FIGS. 16 and 17.

The apparatus of FIGS. 16 and 17 is provided with a false-twisting device 74 arranged downstream of the second roller 72 and a guide roller 75 arranged between the false-twisting device 74 and the first roller 71 in the draw-cutting roller device 44.

In the false-twisting device 74, the drawn-cut composite filament bundle 73 is false-twisted, i.e., twisted and untwisted, between the second roller 72 and the guide roller 75.

The drawn-cut composite filament bundle 73 received by the first roller 71 is bent around the peripheral surface of the first roller 71, travels to the second roller 72, is bent therearound and travels into the false-twisting device 74 while being twisted in a twisting zone 78 between the second roller 72 and the false-twisting device 74, travels to the guide roller 75 while being untwisted in an untwisting zone 79 between the false-twisting device 74 and the guide roller 75, and is turned around the guide roller 75.

Then, the resultant drawn-cut, false-twisted composite filament bundle 76 is wound in a plurality of turns along the path defined by the first and second rollers 71 and 72 as shown in FIG. 16, and finally, leaves the first roller 71 without intersecting the drawn-cut composite filament bundle 73.

In the apparatus shown in FIGS. 16 and 17, the second roller 72 serves to fix a point at which the twisting action for the drawn-cut composite filament bundle 73 is started. Also, the guide roller 75 serves to fix a point at which the untwisting action for the bundle 73 is ended.

The second roller 72 preferably has a plurality of grooves separated from each other by ring-shaped partitions 77, for defining the travel path of the bundle 73, as indicated in FIGS. 16 and 17.

Referring to FIG. 18, the drawn-cut composite filament bundle 73 travels through the first roller 71 and the second roller 72 and is twisted in the zone between the second roller 72 and the false-twisted device (not shown in FIG. 18).

In the twisting zone 78, the drawn-cut composite filament bundle 73 is twisted and the individual short fibers in the bundle 73 are further drawn-cut under a tension created on the bundle 73 by the twisting action.

In the untwisting zone 79, the twisted drawn-cut composite filament bundle is untwisted. This untwisting procedure promotes an entanglement of the short fibers with each other and with the individual filaments (a).

When the false-twisted composite filament bundle 76 is wound in a plurality of turns around the first and second rollers 71 and 72, friction is generated between the peripheral surfaces of the first and second rollers 71 and 72 and the bundle 76, and this friction causes tension to be created in the bundle 73. Under this tension, the short fibers in the bundle 76 are further drawn-cut.

Due to the above-mentioned procedures carried out in the apparatus as indicated in FIGS. 16, 17, and 18, the low elongation individual filaments (b) can be continuously drawn-cut at random portions thereof, and converted to short fibers distributed evenly in the composite filament bundle 76.

Figure 19:
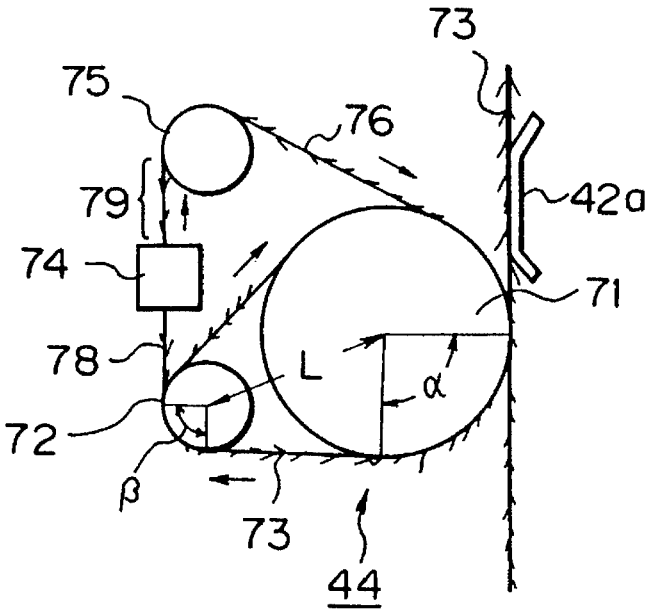
FIG. 19 is an enlarged explanatory side view of the draw-cutting roller device and the false-twisting device as shown in FIG. 14.

Referring to FIG. 19, the first and second rollers 71 and 72 in the draw-cutting roller device 44 are preferably arranged at locations satisfying the following relationship:

$$L \leqq R^1 + R^2 + 50 \text{ mm}$$

wherein L represents a distance between the longitudinal axes of the first roller 71 and the second roller 72, $R^1$ represents a radius of the first roller 71, and $R^2$ represents a radius of the second roller 72. When the above relationship is satisfied, an undesirable disturbance of the individual filaments and the draw-cut short fibers due to air resistance, etc., during the travel thereof through the draw-cutting roller device 44 is effectively prevented.

When the draw-cut composite filament bundle is introduced into the draw-cutting roller device 44 as indicated in FIG. 19, preferably the composite filament bundle 73 be brought into contact with a portion of the peripheral surface of the first roller 71 at a contact angle $\alpha$ of 60 to 180 degrees.

At the contact angle $\alpha$ in the above-mentioned range, the first roller 71 can impart an enhanced transfer effect and a satisfactory pressing effect to the draw-cut composite filament bundle 73, and the draw-cutting procedure can be evenly carried out.

Also, to effectively fix the twist-starting point on the draw-cut composite filament bundle 73 and evenly twist the draw-cut composite filament bundle 73 in the twisting zone 78, preferably the bundle 73 is maintained in contact with the second roller 72 at a contact angle $\beta$ of 45 degrees or more.

Further, the second roller preferably has a diameter of 40 mm or less.

The false-twisting device 74 comprises an interlacing nozzle which can twist and untwist the drawn-cut composite filament bundle 73 in alternate S and Z turns, an air-circling nozzle in which an air eddy flows in one direction, or a false-twisting spindle, and more preferably, is an air-circling nozzle.

If necessary, the false-twisting device 74 has an intertwining action for the short fibers and the individual continuous filaments in the bundle 73, and accordingly, the false-twisting device 74 has two or more air-circling nozzles arranged in series.

After the false-twisting procedure is completed, the resultant drawn-cut, false-twisted composite filament yarn 76 is preferably wound for four turns or more around the first and second rollers 71 and 72.

The false-twisting procedure can be carried out without employing the guide roller 75 arranged between the false-twisting device 74 and the first roller 71.

Figure 20:
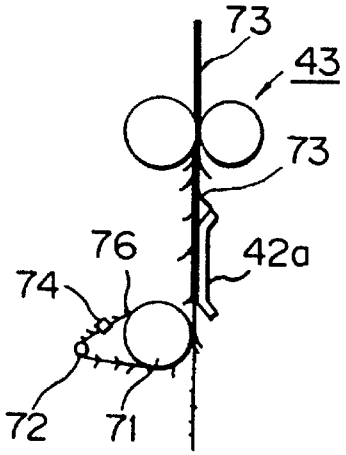
FIGS. 20 to 22 respectively show an explanatory side view of an embodiment of the arrangement of the feeding roller device, the draw-cutting roller device, and the false-twisting device.

Referring to FIG. 20, the false-twisting device 74 is arranged between the second roller 72 and the first roller 71 without arranging the guide roller between the false-twisting device 74 and the first roller 71.

Figure 21:
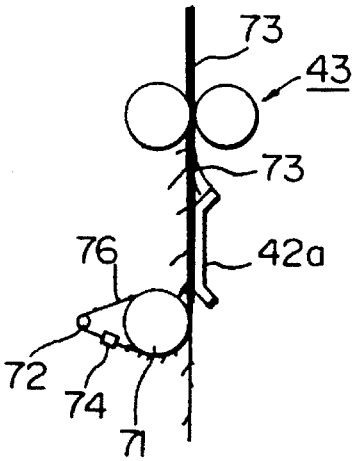

Referring to FIG. 21, the false-twisting device is arranged between the first roller 71, which serves as a twist starting point-fixing roller, and the second roller 72.

Figure 22:
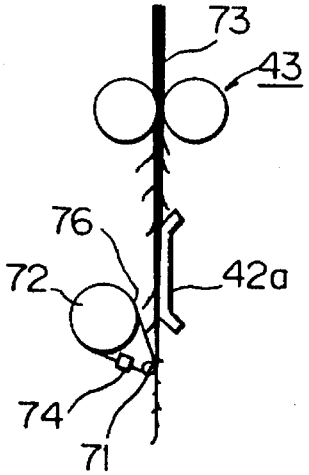

Referring to FIG. 22, the first roller 71 has a smaller diameter than that of the second roller 72, and the false-twisting device 74 is arranged between the thin first roller 71 and the thick second roller 72.

Figure 23:
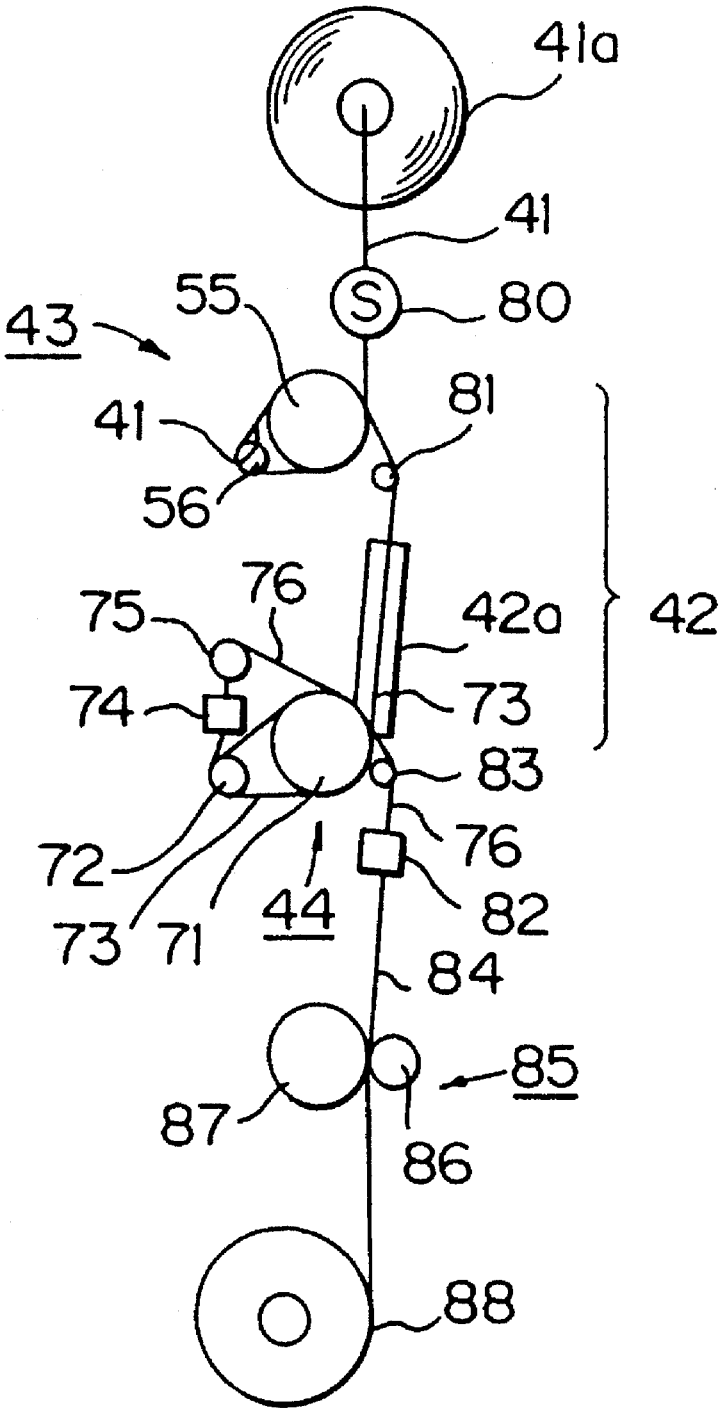
FIG. 23 is an explanatory side view of another embodiment of the apparatus of the present invention.

FIG. 23 shows a preferred apparatus of the present invention, which can produce the short fiber and continuous filament composite yarn at a high speed of 300 m/min or more, more preferably 400 m/min or more. The composite yarn is produced from a composite filament bundle composed of at least one filament bundle of a plurality of high elongation individual filaments (a) and at least one other filament bundle of a plurality of low elongation individual filaments (b).

Figure 24:
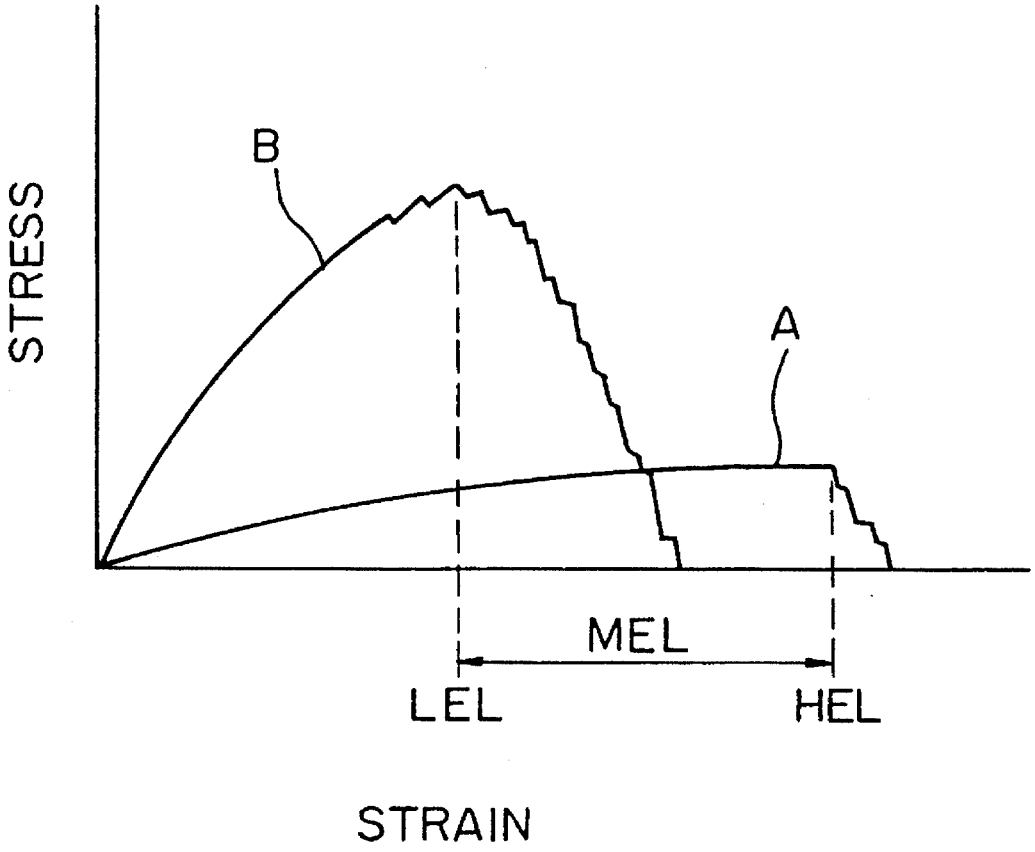
FIG. 24 is a graph showing stress-stain curves of high and low elongation filaments usable for the present invention.

For example, referring to FIG. 24, the high elongation individual filaments (a) (HEL) exhibit the stress-strain curve A and the low elongation individual filaments (b) (LEL) exhibit the stress-strain curve B, as shown in the graph.

Referring to FIG. 23, a composite filament bundle 41 is withdrawn from a package 41*a* and fed to a feeding roller device 43 under a tension adjusted by a tenser 80. The feeding roller device 43 is composed of a thick first roller 55 and a thin second roller 56 spaced from and arranged in parallel to each other. The composite filament bundle 41 is wound in a plurality of turns around the first and second rollers 55 and 56, as shown in the drawing, then introduced into a draw-cutting zone formed between the feeding roller device 43 and a draw-cutting roller device 44.

A bending guide 81 and a sliding guide 42*a* are arranged in this draw-cutting zone 42, and the composite filament bundle 41 is bent around the bending guide 80 and evenly opened, and then slid on the smooth surface of the sliding guide 42*a* while the low elongation individual filaments (b) are stably drawn-cut.

The draw-cutting roller device 44 is composed of a thick first roller 71 and a thin second roller 72. A false-twisting device 74 is arranged downstream of the second roller 72, to provide a twisting zone between the second roller 72 and the false-twisting device 74. Also, a guide roller 75 is arranged between the false-twisting device 74 and the first roller 71, to provide an untwisting zone between the false-twisting device 74 and the guide roller 75.

The resultant drawn-cut, false-twisted composite filament bundle 76 is wound in a plurality of turns around the first and second roller 71 and 72, and then introduced into an intertwining device 82 through a guide roller 83.

In the intertwining device 82, the drawn-cut, false-twisted composite filament bundle is converted to a short fiber and continuous filament composite yarn 84.

The composite yarn 84 is delivered through a delivering roller device 85 composed of a pair of nip rollers 86 and 87 and wound around a bobbin 88.

The apparatus of the present invention is useful for producing a short fiber and continuous filament composite yarn from a composite filament bundle composed of at least one high elongation filament bundle and at least one low elongation filament bundle, by selectively draw-cutting the low elongation filament bundle and intertwining the resultant drawn-cut short fibers with the non-cut filaments in the above-mentioned manner.

The apparatus of the present invention is also usable for producing a drawn-cut fiber-spun yarn from a simple filament bundle by draw-cutting all of the individual filaments and intertwining the resultant drawn-cut short fibers with each other. In this production of the drawn-cut fiber-spun yarn, preferably the draw-cutting procedure is carried out at a relatively low speed, for example, 500 m/min or less.

Table 5 shows the relationships among the draw-cutting speed and the quality of the resultant yarns from a composite filament bundle and a simple filament bundle.

TABLE 5

| Draw-cutting speed (m/min) | | 200 | 300 | 400 | 500 | 600 | 700 | 800 |
|---|---|---|---|---|---|---|---|---|
| Composite filament bundle (*)4 | Process-ability u % | Excellent 5.2 | Excellent 5.4 | Excellent 5.3 | Excellent 5.6 | Excellent 5.6 | Excellent 5.9 | Good 6.8 |
| Simple filament bundle (*)5 | Process-ability u % | Excellent 6.3 | Excellent 6.7 | Good 7.0 | Not good 87 | Bad —(*)6 | Bad —(*)6 | Bad —(*)6 |

Note:
(*)4 High elongation filament bundle
Total denier: 48
Individual filament denier: 4.0
Low elongation filament bundle
Total denier: 92
Individual filament denier: 0.7
(*)5 Total denier: 140
Individual filament denier: 0.7
(*)6 Failed to produce a spun yarn

EXAMPLES

The present invention will be explained by the following examples.

Example 1

A polyethylene terephthalate resin containing 0.3% by weight of titanium dioxide particles and having a limiting viscosity number of 0.64 was melted at a temperature of 295° C. and extruded through a spinneret having 80 extrusion holes having a diameter of 0.18 mm and a land length of 0.90 mm and 4 holes having a diameter of 0.39 mm and a land length of 2.16 m. The extruded filamentary melt streams were cooled by a cooling air flow in a transverse direction to the filamentary melt streams, the resultant solidified composite filament bundle was oiled with an aqueous emulsion of the oiling agent X, Y, or Z having the composition as indicated in Table 6, the oiled composite filament bundle was drawn at a draw ratio of 1.33 while passing through an air circling stream, heat-treated at a temperature of 120° C., and then taken up at a take-up speed of 4000 m/min.

The resultant composite filament bundle was composed of 80 high elongation individual filaments having a denier of 0.48 and an ultimate elongation of 75% and 4 low elongation individual filaments having a denier of 4.0 and an ultimate elongation of 21%.

In Table 6, the oiling agents X and Y contained components which were in the state of a solid at room temperature, and the oiling agent Z contained components which were in the state of a liquid at room temperature.

TABLE 6

| Oiling agent | Component | Content (wt %) |
|---|---|---|
| X | Potassium stearylphosphate | 90 |
| | POE (10)-laurylether | 10 |
| Y | Laurylphosphate | 60 |
| | Potassium laurate | 40 |
| Z | Mineral oil | 63 |
| | Oleyl alcohol-ethyleneoxide addition product | 12 |
| | Polyethyleneglycol-condensed laurate | 20 |
| | Dioctyl sulfosuccinate | 5 |

The resultant composite filament bundles had the properties as indicated in Table 7.

TABLE 7

| Run No. | Oiling agent | OPU (wt %) | No. of entanglements per m | Spinning property | Random drawncutting property |
|---|---|---|---|---|---|
| 1 | X | 0.20 | 4 | Good | Good |
| 2 | X | 0.20 | 12 | " | Satisfactory |
| 3 | Y | 0.20 | 6 | " | Good |
| 4 | Z | 0.20 | 4 | " | Not good |
| 5 | Z | 0.10 | 3 | " | Satisfactory |

Example 2

A composite filament bundle was prepared by joining three of the composite filament bundles No. 5 shown in Table 7 and subjected to a drawn-cut, non-twist spinning process by the apparatus as shown in FIG. 6. In this process, the composite filament bundle 11 was drawn at a draw ratio of 1.3 while bending the bundle 11 around a bending guide 21 and press-sliding on a sliding guide 22, to selectively draw-cut only the low elongation individual filaments in the bundle 11. The drawn-cut composite filament bundle was withdrawn from the draw-cutting zone 13 through a draw-cutting roller device 15 and an air-sucking nozzle 16, in which the composite filament bundle was sucked by an action of an air-circling flow. The withdrawn composite filament bundle was passed through an intertwining device 17 in which the drawn-cut short fibers were intertwined with the non-cut continuous filaments by the action of a strong air-circling flow, to convert the drawn-cut composite filament bundle to a short fiber and continuous filament composite yarn. The resultant composite yarn was taken up by a delivery roller device 19 and wound around a package 20.

The bending guide 21 was composed of a ceramic rod having a diameter of 2 cm, and the composite filament bundle was bent at a bending angle of 140 degrees.

In the draw-cutting procedure, the draw-cutting length was 280 mm and the draw-cutting speed was 400 m/min.

In the air-sucking nozzle 16, the sucking pressure was 2 kg/cm$^2$. In the intertwining device 17, the intertwining air pressure was 3 kg/cm$^2$ and the overfeed was 5%. The overfeed is defined as follows.

$$\text{Overfeed (\%)} = \frac{S_1 - S_2}{S_1}$$

wherein $S_1$ represents a peripheral speed of the draw-cutting roller device and $S_2$ represents a peripheral speed of the delivery roller device.

The resultant composite yarn has the appearance as shown in FIG. 1. Namely, the drawn-cut short fibers 5 having tapered end portions 7 were intertwined with non-cut individual continuous filaments 4. Some tapered end portions 7 of the short fibers 5 were projected as free end portions. Also, the short fibers 5 form a plurality of loops 6 projecting in the form of waves from the bundle of the non-cut continuous filaments (the core portion) toward the outside of the core portion. The heights of the waves were different and form a multilayered peripheral portion of the composite yarn. The multilayer-forming loops are substantially evenly distributed along the longitudinal axis of the composite yarn, and the free end portions of the short fibers are wound around the bundle of the non-cut individual filaments (the core portion) to uniformly cover the core portion by the peripheral portion composed of the short fibers. The composite yarn has a uniform appearance.

In the composite yarn, the non-cut individual filaments had an average shrinkage in boiling water of 17.1% (R=4.5), the drawn-cut short fibers had an average shrinkage in boiling water of 7.6%, and the middle portions, the tapered end portions and the other end portions of the short fibers respectively had an average shrinkage in boiling water of 7.6%, 4.5% (R= 3.5), and 5.8% (R=2.0).

The physical properties of the composite yarn are shown in Table 8.

TABLE 8

| Physical property of composite yarn | Unit | Value |
|---|---|---|
| Total denier | d | 129 |
| Non-cut filaments | | |
| DA | d | 38 |
| dB | " | 3.2 |
| Draw-cut short fibers | | |
| DB | d | 91 |
| dB | " | 0.38 |
| Average length (Lm) | cm | 35 |
| u % | % | 5.5 |
| No. of thin portions | per 150 m | 0 |
| No. of thick portions | per 150 m | 0 |
| No. of neps | per 150 m | 0 |
| Shrinkage in boiling water | % | 15.0 |
| $LB_0/LA_0$ (ratio) | | 1.02 |
| $LB_1/LA_1$ (ratio) | | 1.05 |

From Table 8, the following were calculated:

$dA/dB = 8.4$ $U \cdot N^{1/2} = 87.5$ $DA/DB = 0.47$

The polyester composite yarn was twisted at a twist number of 600 turns/m and the twisted composite yarn was converted to a plain weave having a warp density of 84 yarns/25.4 mm and a weft density of 72 yarns/25.4 mm. The plain weave was subjected to a dying-finishing process including a weight-reduction treatment with alkali in a weight reduction of about 2% and a calendering treatment. The dyed and finished plain weave had a uniformly colored appearance even though the dyeing properties of non-cut filaments and the drawn-cut short fibers were slightly different from each other, and was free from defects due to uneven yarn thickness and a presence of neps. Also, the dyed and finished plain weave had a soft touch and a satisfactory resilience similar to those of a very high grade fabric made from super long cotton fibers.

Surprisingly, although the fabric had a number of fluffs formed on the surface thereof when a singeing operation was not applied thereto, and the polyester resin used for the composite filament bundle had a usual limited viscosity number [η], the fabric exhibited a very high resistance to pilling of a class 4 when measured by a test in accordance with the ICI method for, 10 hours.

The reasons for the high pilling resistance are not completely clear, but it is assumed that, during the drawn-cutting and intertwining procedures for the production of the short fiber and continuous filament composite yarn, the drawn-cut short fibers and the non-cut individual continuous filaments are evenly mixed, and random portions of the short fibers pierce the bundle of the non-cut continuous filaments and intertwine with the non-cut continuous filaments, and therefore, the short fibers are highly resistant to extraction from the fabric structure and exhibit a lowered ultimate elongation.

Comparative Example 1

The same composite filament bundle as that mentioned in Example 1 was processed by the conventional drawing apparatus as shown in FIG. 9, or the conventional draw-false twisting apparatus as shown in FIG. 9, to draw or draw-fast twist the composite filament at a draw ratio of 1.3 in the draw-cutting zone 24 between the feeding roller device 25 and the delivering roller device 27 or in the draw-cut, false twisting zone 29 between the feeding roller device 30 and the delivering roller device 32.

It was found that the composite filament bundle 11 introduced into the draw-cutting zone 24 or the draw-cut, false twisting zone 29 was immediately broken, and thus a short fiber and continuous filament composite yarn was not obtained.

Even when the draw cutting procedure or the draw-cut, false twisting procedure was carried out at room temperature, without heating by the heating plate 26, or the false-twisting device 31 was omitted from the apparatus of FIG. 10, the composite filament bundle could not be converted to the short fiber and continuous filament composite yarn.

Example 3

The same procedures as in Example 2 were carried out except that the composite filament bundle No. 5 was replaced by the composite filament bundle No. 1 shown in Table 7.

The resultant short fiber and continuous filament composite yarn had a further improved uniformity of the distribution of the multilayered loops of the short fibers along the longitudinal axis of the composite yarn, and a more preferable appearance than those in Example 2.

In the resultant composite yarn, the non-cut continuous filaments had a shrinkage in boiling water of 16.2% (R=4.3) and the short fibers had the following shrinkages in boiling water.

Average shrinkage in boiling water of short fibers: 6.3%.

Average shrinkage in boiling water of middle portions of short fibers: 9.4%

Average shrinkage in boiling water of tapered end portions of short fibers: 4.2% (R=3.2)

Average shrinkage in boiling water of other end portions of short fibers: 5.3% (R=1.8)

The physical properties of the composite yarn are shown in Table 9.

TABLE 9

| Physical property of composite yarn | Unit | Value |
|---|---|---|
| Total denier | d | 129 |
| Non-cut continuous filaments | | |
| DA | d | 38 |
| dA | " | 3.2 |
| Drawn-cut short fibers | | |
| DB | d | 91 |
| dB | " | 0.38 |
| Average fiber length Lm | cm | 4.7 |
| u % | % | 4.7 |
| No. of thin portions | per 150 m | 0 |
| No. of thick portions | per 150 m | 0 |
| No. of neps | per 150 m | 0 |
| Shrinkage (in boiling water) | % | 14.4 |
| $LB_0/LA_0$ (ratio) | | 1.03 |
| $LB_1/LA_1$ (ratio) | | 1.06 |

From Table 9, the following were calculated:

$$dA/dB=8.4$$

$$u\cdot N^{1/2}=74.7$$

$$DA/DB=0.47$$

The composite yarn was converted to a plain weave in the same manner as in Example 2, and the plain weave was dyed and finished in the same manner as in Example 2.

The resultant dyed and finished composite yarn fabric had a similar appearance, a soft touch and resilience, and a high pilling resistance, as in Example 2, except that the pilling resistance was class 4.5.

Example 4

A polyester composite filament bundle having a total denier of 180 was prepared by doubling a bundle of 12 high elongation polyester filaments having a denier of 5 and an ultimate elongation of 65% and a bundle of 240 low elongation polyester filaments having a denier of 0.5 and an ultimate elongation of 23%.

The composite filament bundle was converted to a short fiber and continuous filament composite yarn by using the apparatus as shown in FIG. 23, under the following conditions.

| | |
|---|---|
| (1) Draw-cutting speed (peripheral speed of draw cutting rollers) | 400 m/min |
| (2) Draw ratio (ratio of peripheral speed of draw cutting rollers to that of feeding rollers) | 1.35 |
| (3) Contact angle α of first roller in draw-cutting roller device | 90 degrees |
| (4) Contact angle β of second roller in draw-cutting roller device | 90 degrees |
| (5) Diameter of first roller in draw-cutting roller device | 100 mm |
| (6) Diameter of second roller in draw-cutting roller device | 22 mm |
| (7) Distance L between first and | 130 mm |

-continued

| | | |
|---|---|---|
| | second rollers | |
| (8) | Air pressure in false twisting nozzle (air circling nozzle) | 2 kg/cm$^2$ |
| (9) | Draw-cutting length (*)7 | 380 mm |
| (10) | Bending guide | Employed |
| (11) | Sliding guide | Employed |
| (12) | Number of windings of false-twisted composite filament bundle around first and second rollers | 7 turns |
| (13) | Air pressure in intertwining device (Air circling nozzle) | 5 kg/cm$^2$ |
| (14) | Overfeed in intertwining zone | 5.5% |

Note:
(*)7 . . . The draw-cutting length is a length of the travelling path of the composite filament length between a point at which the composite filament length leaves the feeding roller device and a point at which the composite filament bundle comes into contact with the second roller of the draw-cutting roller device.

The breakage of yarn per day was 0.5 time per one apparatus. This means that the draw-cut, non-twist, intertwining spinning process was very stable.

The resultant composite yarn had the following physical properties:

| | | |
|---|---|---|
| (1) | Total denier | 133 |
| (2) | Tensile strength at twist number of 600 turns/m | 41 g/d |
| (3) | Ultimate elongation at the above-mentioned twist number | 20% |
| (4) | Shrinkage in boiling water | |
| | Composite yarn | 16% |
| | Non-cut filaments | 17% |
| | Drawn-cut short fibers | 7% |
| (5) | u % | 5.5% |
| (6) | No. of thin portions per 150 m | 0 |
| (7) | No. of thick portions per 150 m | 0 |
| (8) | No. of neps per 150 m | 3 |

The composite yarn was twisted at a twist number of 500 turns/m, and the twisted composite yarn was converted to a plain weave having a warp density of 85 yarns/25.4 mm and a weft density of 73 yarns/25.4 mm.

The fabric was subjected to a dyeing-finishing process including a weight reduction treatment with alkali at a weight reduction of about 20% and a light calendering treatment.

The resultant dyed and finished fabric had a uniform appearance, a soft touch, an appropriate draping property, and a satisfactory resilience similar to those of a high grade fabric made of super long cotton fibers. Especially, in view of the u% value, the composite yarn had excellent uniformity in thickness and appearance.

Example 5

A polyester composite filament bundle having a total denier of 250 was prepared by doubling a bundle of 8 high elongation individual continuous polyester filaments having a denier of 6.3 and an ultimate elongation of 55% and a bundle of 144 low elongation individual continuous polyester filaments having a denier of 1.4 and an ultimate elongation of 26%.

The composite filament bundle was converted to a short fiber and continuous filament composite yarn having a denier of 187 by using the apparatus shown in FIG. 23 under the following conditions.

| | | |
|---|---|---|
| (1) | Draw-cutting speed (peripheral speed of draw cutting rollers) | 200 m/min |
| (2) | Draw ratio (ratio of peripheral speed of draw cutting rollers to that of feeding rollers) | 1.34 |
| (3) | Contact angle α of first roller in draw-cutting roller device | 100 degrees |
| (4) | Contact angle β of second roller in draw-cutting roller device | 80 degrees |
| (5) | Diameter of first roller in draw-cutting roller device | 100 mm |
| (6) | Diameter of second roller in draw-cutting roller device | 24 mm |
| (7) | Distance L between first and second rollers | 70 mm |
| (8) | Air pressure in false twisting nozzle (Air circling nozzle) | 3 kg/cm$^2$ |
| (9) | Draw-cutting length (*)7 | 380 mm |
| (10) | Bending guide | Employed |
| (11) | Sliding guide | Employed |
| (12) | No. of windings of false-twisted composite filament bundle around first and second rollers | 6 turns |
| (13) | Air pressure in intertwining device (Air circling nozzle) | 5 kg/cm$^2$ |
| (14) | Overfeed in intertwining zone | 6% |

The number of yarn breakages per day was 0.8. This means that the above-mentioned procedures were carried out very smoothly.

The physical properties of the resultant composite yarn were as follows.

| | | |
|---|---|---|
| (1) | Total denier | 187 |
| (2) | Tensile strength at a twist number of 500 turns/m | 3.7 g/d |
| (3) | Ultimate elongation at above-mentioned twist number | 24% |
| (4) | Shrinkage in boiling water | |
| | Composite yarn | 21% |
| | Non-cut filaments | 23% |
| | Drawn-cut short fibers | 13% |
| (5) | u % | 7.0% |
| (6) | No. of thin portions per 150 m | 0 |
| (7) | No. of thick portions per 150 m | 0 |
| (8) | No. of neps per 150 m | 60 |

The composite yarn was twisted at a twist number of 600 turns/m and then converted to a plain weave having a warp density of 55 yarns/25.4 mm and a weft density of 51 yarns/25.4 mm.

The fabric was singed and subjected to an antipilling treatment and then to a weight reduction treatment with alkali. The treated fabric was dyed and finished in a customary manner.

The dyed and finished fabric had a cool look and soft touch, a high resilience and a spun yarn fabric-like appearance, and thus was useful for high grade summer wear.

We claim:

1. A short fiber and continuous filament composite yarn comprising:

(A) a core portion comprising a plurality of evenly cold-drawn, non-crimped continuous filaments extending substantially in parallel to each other; and (B) a peripheral portion located around the core portion and comprising a plurality of cold draw-cut, non-crimped short fibers provided with tapered end portions thereof and having a smaller latent shrinkage in boiling water than that of the continuous filaments, said short fibers being intertwined at random portions thereof with the continuous filaments in the core portion and forming a plurality of loops projecting in the form of waves having different wave heights from the core portion toward the outside thereof.

2. The composite yarn as claimed in claim 1, wherein the individual short fibers have a smaller denier than that of the individual continuous filaments.

3. The composite yarn as claimed in claim 1, wherein the latent shrinkage in boiling water of the short fibers varies along the longitudinal axes of the short fibers and the short fibers have an average latent shrinkage in boiling water of 16% or less.

4. The composite yarn as claimed in claim 1, wherein the continuous filaments are substantially bundled together to form the core portion; random portions of the short fibers are penetrated into the bundle of the continuous filaments in the transversal directions of the composite yarn and intertwined with the continuous filaments; other random portions of the short fibers form a plurality of loops projecting in the form of waves having different heights, from the continuous filament bundle toward the outside thereof to form the peripheral portion of the composite yarn; and a portion of the tapered free end portions of the short fibers is projected from the continuous filament bundle to the outside thereof, to form a portion of the peripheral portion of the composite yarn, whereby the latent shrinkage of the composite yarn is caused to vary at random in the transversal and longitudinal directions of the composite yarns, and the core portions are covered by the peripheral portions.

5. The composite yarn as claimed in claim 1, which satisfies the relationship (IV):

$$U \cdot N^{1/2} \leqq 104$$

wherein U represents a yarn evenness value in per unit by weight as measured by a yarn evenness tester, and N represents the total number of the short fibers and the continuous filaments appearing in a cross-section of the composite yarn.

6. The composite yarn as claimed in claim 1, which satisfies the relationships (I) to (III):

$$6 \geqq dA \geqq 3 \quad \text{(I)}$$

$$dB < 0.8 \quad \text{(II)}$$

and $$1.5 \geqq DA/DB \geqq 0.25 \quad \text{(III)}$$

wherein dA represents a denier of the individual continuous filaments, dB represents a denier of the individual short fibers, DA represents a total denier of the individual continuous filaments, and DB represents a total denier of the short fibers in the composite yarn.

7. The composite yarn as claimed in claim 1, wherein the continuous filaments comprise a polyester resin.

8. The composite yarn as claimed in claim 1, wherein the short fibers comprise a polyester resin.

9. The composite yarn as claimed in claim 1, wherein the individual continuous filaments have a multilobal cross-sectional profile.

* * * * *